US010273648B2

(12) United States Patent
Jaecklin

(10) Patent No.: US 10,273,648 B2
(45) Date of Patent: Apr. 30, 2019

(54) BUILDING ELEMENTS FOR MAKING RETAINING WALLS, AND SYSTEMS AND METHODS OF USING SAME

(71) Applicant: Evergreen Walls, Inc., Norcross, GA (US)

(72) Inventor: Felix P. Jaecklin, Norcross, GA (US)

(73) Assignee: EVERGREEN WALLS, INC., Norcross, GA (US)

( * ) Notice: Subject to any disclaimer, the term of this patent is extended or adjusted under 35 U.S.C. 154(b) by 0 days.

(21) Appl. No.: 15/448,134

(22) Filed: Mar. 2, 2017

(65) Prior Publication Data

US 2017/0254042 A1 Sep. 7, 2017

Related U.S. Application Data

(60) Provisional application No. 62/302,793, filed on Mar. 2, 2016.

(51) Int. Cl.
*E02D 29/02* (2006.01)

(52) U.S. Cl.
CPC ..... *E02D 29/025* (2013.01); *E02D 29/0266* (2013.01); *E02D 2300/0006* (2013.01); *E02D 2300/0026* (2013.01)

(58) Field of Classification Search
CPC ..... E02D 29/025
See application file for complete search history.

(56) References Cited

U.S. PATENT DOCUMENTS 3,379,017 A * 4/1968 Kusatake ..... E02L 33/14 405/31
4,619,560 A * 10/1986 Crinnion ..... E02D 29/025 405/284
4,982,544 A * 1/1991 Smith ..... E02D 29/0241 52/603
5,044,834 A * 9/1991 Janopaul, Jr. ..... E02D 29/0241 405/262
5,066,169 A * 11/1991 Gavin ..... E02D 29/0241 405/262
5,131,791 A * 7/1992 Kitziller ..... E02D 29/0241 405/262
5,163,261 A * 11/1992 O'Neill ..... B28B 7/0079 405/284

(Continued)

FOREIGN PATENT DOCUMENTS

CA 2314417 A1 * 11/2000 ..... E02D 29/025
CA 2755112 A1 * 3/2013 ..... E02D 29/025

(Continued)

*Primary Examiner* — Frederick L Lagman
(74) *Attorney, Agent, or Firm* — Ballard Spahr LLP

(57) ABSTRACT

A building element for coupling with other building elements to erect a retaining wall. Optionally, the building element can have a modular construction. The building element can have a face panel and a beam member that extends substantially perpendicularly relative to the face panel. The building elements can have a variety of different configurations, providing flexibility in the design of retaining walls. Optionally, each building element can define alignment voids that receive portions of alignment posts for ensuring vertical alignment between adjacent building elements or portions of building elements.

18 Claims, 22 Drawing Sheets

(56) References Cited

U.S. PATENT DOCUMENTS 5,337,527 A * 8/1994 Wagenaar ..... E02D 29/025 405/284
5,350,256 A * 9/1994 Hammer ..... E02D 29/025 405/262
5,456,554 A * 10/1995 Barrett ..... E02D 29/0225 405/262
5,474,405 A * 12/1995 Anderson ..... B29C 49/2408 405/262
5,704,183 A * 1/1998 Woolford ..... B28B 7/0097 405/284
5,788,423 A * 8/1998 Perkins ..... E02D 29/025 405/284
5,820,304 A * 10/1998 Sorheim ..... E02D 29/0233 405/262
6,994,495 B1 * 2/2006 Carey ..... E02D 29/025 405/284
7,168,892 B1 * 1/2007 MacDonald ..... E02D 29/0225 405/284
2005/0016106 A1 * 1/2005 Dawson ..... B28B 7/241 52/562
2006/0177278 A1 * 8/2006 Carey ..... E01B 2/00 405/285
2007/0110524 A1 * 5/2007 MacDonald ..... E02D 29/025 405/286
2008/0317557 A1 * 12/2008 Jaecklin ..... E02D 29/025 405/273
2009/0041552 A1 * 2/2009 Hammer ..... E02D 29/0225 405/284
2009/0148242 A1 * 6/2009 Collet ..... B28B 7/0029 405/286
2009/0162147 A1 * 6/2009 Klenert ..... E02D 29/025 405/284
2010/0139183 A1 * 6/2010 Eigl ..... E02D 29/0233 52/127.1
2011/0072753 A1 * 3/2011 MacDonald ..... E02D 29/025 52/562
2011/0217127 A1 * 9/2011 MacDonald ..... E02D 29/025 405/284
2011/0318100 A1 * 12/2011 Rainey ..... E02D 29/025 404/6
2012/0063853 A1 * 3/2012 Bott ..... E02D 29/025 405/284
2013/0067845 A1 * 3/2013 MacDonald ..... E04C 1/395 52/563
2014/0234025 A1 * 8/2014 Rainey ..... E02D 29/025 404/6
2015/0159339 A1 * 6/2015 Castonguay ..... E02D 29/0225 405/284

FOREIGN PATENT DOCUMENTS

WO WO-9720997 A1 * 6/1997 ..... E02D 29/0216
WO WO-2005100700 A1 * 10/2005 ..... E02D 29/0225
WO WO-2007122485 A2 * 11/2007 ..... E02D 29/025
WO WO-2010052806 A1 * 5/2010 ..... E02D 29/025

* cited by examiner

BUILDING ELEMENTS FOR MAKING RETAINING WALLS, AND SYSTEMS AND METHODS OF USING SAME

CROSS-REFERENCE TO RELATED APPLICATIONS

This application claims priority to and the benefit of the filing date of U.S. Provisional Patent Application No. 62/302,793, filed Mar. 2, 2016, which is hereby incorporated herein by reference in its entirety.

FIELD

The present disclosure relates generally to building elements for wall structures. More particularly, the present disclosure relates to a plurality of building elements that are operably coupled to each other to erect a retaining wall.

BACKGROUND

It is common practice to use prefabricated building elements and particular masonry works such as walls for retaining slopes and slopes along roads, motorways, railways or the like, or for retaining walls for creating drops between urban levels, especially by various types of prefabricated building elements. Such elements usually consist of concrete elements, placed one at the top of the other, and then filled with material such as earth, sand, gravel, and the like. Previous approaches have been developed to building elements for a retaining wall. One example of such an approach is described in U.S. Pat. No. 7,845,885, which is incorporated herein by reference in its entirety.

Currently, building elements require expensive molds and a minimum of one night to rest in the mold to allow time for the material to harden. In addition, the process used to generate a building element results in a building mold with limited variability. Thus, the resulting building element limits the structural variability of the retaining walls that can be constructed using the building element. There is a need in the pertinent art for building elements with increased variability in structure, thereby allowing for increased variability in the structures of retaining walls produced using the building elements.

SUMMARY

The disclosure relates to the building of large and heavily loaded retaining walls by a set of prefabricated building elements. Optionally, the prefabricated building elements can include at least two different types of prefabricated building elements. During installation, the building elements can be operably engaged to build a retaining wall. To solidify the retaining wall, earth fillers such as dirt and the like can be used to support the wall.

Disclosed herein are building elements and systems and methods of using building elements to erect a retaining wall. In some aspects, the disclosed building elements can have a modular construction that simplifies production of the building elements and the retaining walls formed by the building elements. In these aspects, it is contemplated that the modular construction increases the ease in which the dimensions and characteristics of a building element can be selectively varied at a particular location within the wall construction to achieve a particular structural need. It is further contemplated that the modular construction can lower production costs, lower investment costs for molds, and ease transport of building elements.

In other aspects, a building element can be configured to be coupled to at least one other building element to form a retaining wall. The building element can comprise a face panel that defines a front surface and a rear surface positioned on an opposing side of the face panel from the front surface. The face panel can comprise a length dimension that is oriented along a first axis, a width/thickness dimension that is oriented along a second axis that is perpendicular to the first axis, and a height dimension that is oriented along a third axis that is perpendicular to the first and second axes. The building element can also comprise at least one beam member coupled to the rear surface of the face panel. The beam member can comprise an upper surface and a lower surface, and at least one surface of the upper surface and the lower surface can define an alignment void that is configured to receive a complementary portion of an adjacent building element. The beam member can also comprise a height dimension oriented along the third axis and a length dimension oriented along the second axis (such that the beam member is substantially perpendicular to the rear surface of the face panel and extends away from the rear surface of the face panel relative to the second axis).

Optionally, in various aspects, the building elements can be engaged to one another using at least one alignment post. The alignment post can comprise a stem and a cap. The stem can have a longitudinal axis and a length dimension along the longitudinal axis. In use, it is contemplated that the longitudinal axis of the stem can be parallel or substantially parallel to the third axis disclosed herein. The cap can comprise a top surface and a bottom surface, wherein the top surface comprises a first cross sectional area and the bottom surface comprises a second cross sectional area. The stem can be coupled to the cap through the bottom surface. In exemplary aspects, a first portion of the stem can be embedded within the cap, with a second portion of the stem extending downwardly and away from the bottom surface.

In other aspects, a plurality of building elements as disclosed herein can be operably engaged to erect a retaining wall system. The retaining wall system can comprise a plurality of building elements, wherein each building element can comprise a face panel and at least one beam member. The face panel can comprise a front surface and a rear surface positioned on an opposite side of the face panel from the front surface. At least one beam member can be coupled to the rear surface of the face panel. The beam member can comprise an upper surface and a lower surface, and at least one surface of the upper surface and lower surface can define an alignment void. The retaining wall system can further comprise an alignment post, and at least a portion of a stem of the alignment post can be configured for receipt within an alignment void of a first building element. Depending upon the orientation of the alignment post, the stem of the alignment post can be received within an alignment void that extends upwardly from the lower surface of the beam member or an alignment void that extends downwardly from the upper surface of the beam member, and a cap portion of the alignment post can be configured to extend either (a) above the upper surface or (b) below the lower surface. A second building element can define an alignment void that is configured to receive the cap of the alignment post when beam members of the first and second building elements are positioned in vertical alignment with one another.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

These and other features of the disclosure will become more apparent in the detailed description in which reference is made to the appended drawings wherein:

FIG. 4 depicts two building elements having reinforcement wings with straight profiles. FIG. 5 depicts two building elements having reinforcement wings with curved or arcuate profiles. FIG. 6 depicts two building elements having reinforcement wings with different profiles, with the reinforcement wings of one building element having curved or arcuate profiles and the reinforcement wings of another building element having straight profiles.

DETAILED DESCRIPTION

Figure 1:
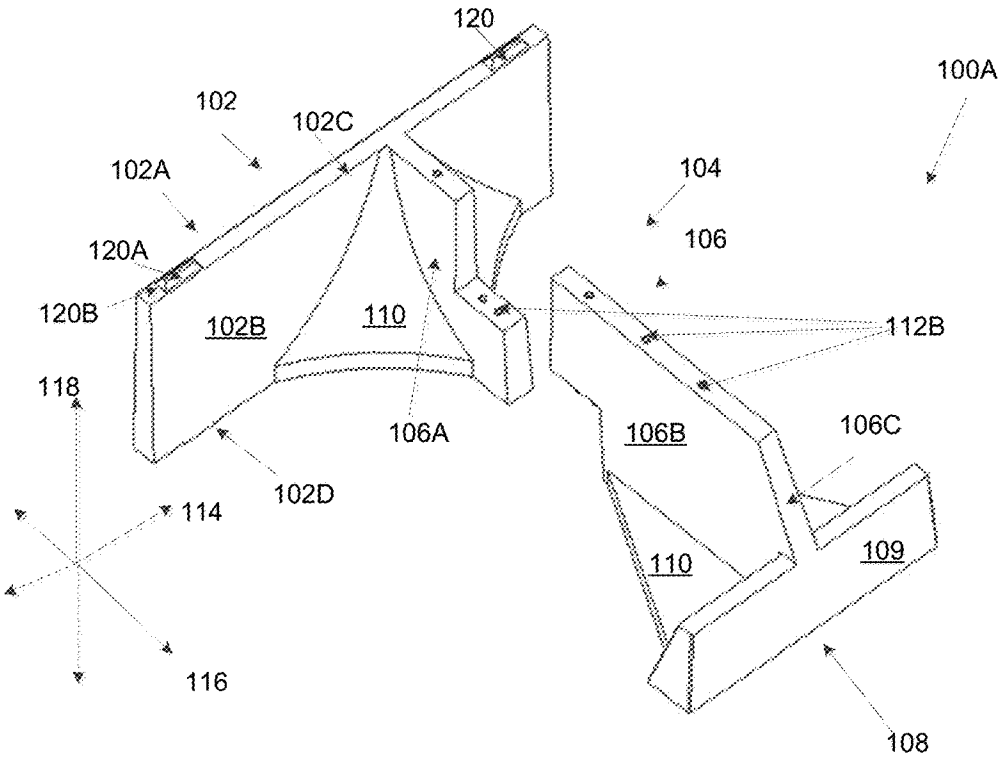
FIG. 1 is a rear perspective view of an exemplary modular building element having a single beam member as disclosed herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a beam member" can include two or more such beam members unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The word "substantially" as used herein can be used to define an angular tolerance of +/−15 degrees with respect to a disclosed (e.g., desired) angular relationship between two geometric entities. For example, "substantially vertical" can indicate that a reference surface or body is oriented vertically or within +/−15 degrees of absolute vertical alignment. Similarly, "substantially collinear" can indicate that two bodies can are collinear or positioned within an alignment divergence of +/−15 degrees of a collinear orientation (with the second body having an angular orientation relative to the first body that is less than or equal to 15 degrees and greater than or equal to −15 degrees).

In the following description, the orientation of the components of the disclosed building elements, retaining walls, and wall systems can be described with reference to a series of axes, including a first axis 114, a second axis 116 that is perpendicular to the first axis, and a third axis 118 that is perpendicular to the first and second axes. A primary plane can be defined by and contain the first axis and the second axis. A secondary plane can be defined by and contain the second axis and the third axis. A tertiary plane can defined by and contain the first axis and the third axis.

In various aspects, described herein with reference to FIGS. 1-22 are building elements 100, 100A, 1006, 100C, 100D, 100E that are configured to be assembled together with at least one other building element to form a retaining wall 300. In these aspects, the building elements can comprise a face panel defining a front surface and a rear surface oriented on an opposing side of the face panel from the front surface. It is contemplated that the face panel can comprise a length dimension oriented along the first axis 114 and a height dimension oriented along the third axis 118. In additional aspects, and as further disclosed herein, the building elements can further comprise at least one beam member coupled to the rear surface of the face panel. Each beam member can have an upper surface and a lower surface. The beam member can comprise a height dimension oriented along the third axis 118 and a length dimension oriented along the second axis 116. Optionally, in exemplary aspects, at least one surface of the upper surface and the lower surface of at least one beam member can define an alignment void as further disclosed herein.

FIGS. 1-6 depict examples of a building element 100A that can be used to form at least a portion of a retaining wall 300. In an aspect, building element 100A can comprise a face panel 102 and at least one beam member 104. To provide a framing structure for a retaining wall, the face panel 102 can be coupled or secured to the beam member 104. Optionally, in exemplary aspects, a portion of each beam member 104 can be permanently secured to or integrally formed with a corresponding face panel 102. In an aspect, the face panel 102 can comprise a front surface 102A and a rear surface 1026. The front surface 102A and the rear surface 1026 can be defined on opposing sides of the face panel 102.

As depicted in FIG. 1, the face panel 102 can comprise a rectangular surface comprising a length dimension, which can extend along the first axis 114. The face panel 102 can further comprise a width/thickness dimension, which can extend along the second axis 116. The face panel 102 can still further comprise a height dimension, which can extend along the third axis 118. In a further aspect, the face panel can be oriented at an angle with respect to the primary plane, which contains and is defined by the first axis 114 and the second axis 116. Optionally, in this aspect, the face panel 102 can be perpendicular or substantially perpendicular to the primary plane (and the second axis 116). That is, the face panel 102 can be oriented vertically or substantially vertically (approximately 90 degrees) with respect to the primary plane defined by the first and second axes 114, 116 (and parallel or substantially parallel with respect to the third axis 118). In general, the primary plane will be approximately level and can be parallel or substantially parallel to a ground surface on which the retaining wall is erected. In a further aspect, at least a portion of the rectangular surface of the face panel 102 can be coplanar or substantially coplanar with the secondary plane, which contains and is defined by the first axis 114 and the third axis 118.

Although generally described herein as having a flat, rectangular construction, it is contemplated that at least a portion of the face panel 102 can have a radius of curvature that defines an arcuate profile (e.g., a convex or concave profile). For example, the face panel can bow with respect to an arcuate path determined by the associated radius.

Figure 12:
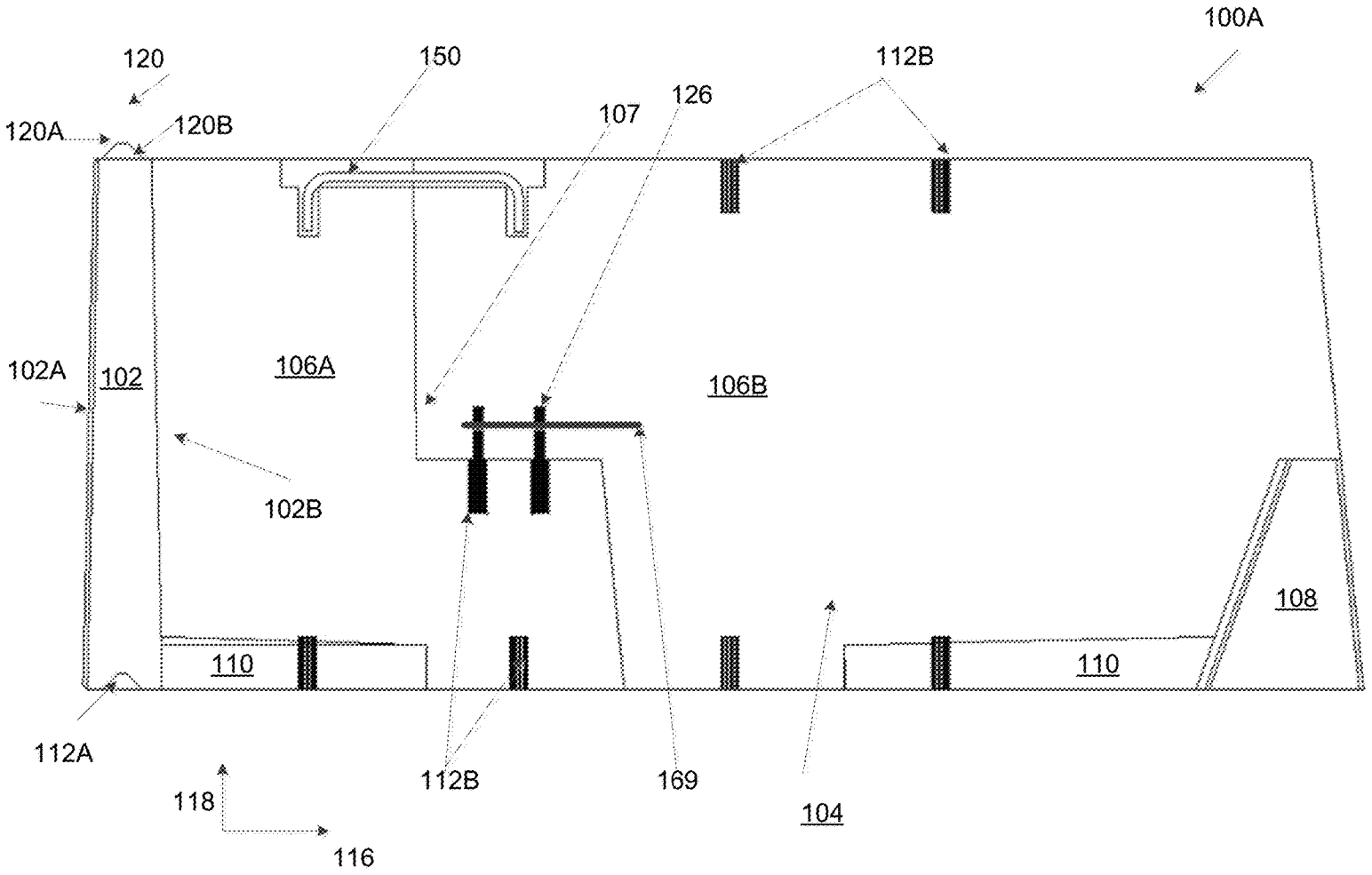
FIG. 12 is a cross-sectional side view of the modular building element of FIG. 1, following assembly of the building element.

In another optional configuration, and as shown in FIGS. 1-6, the face panel 102 can also comprise at least one projection 120 extending outwardly from one of a top surface 102C or a bottom surface 102D of the face panel. Additionally, or alternatively, as shown in FIG. 12, the face panel 102 can define at least one inwardly recessed notch or slot 112A. In exemplary aspects, the face panel can comprise a plurality of projections 120 extending outwardly from the top surface 102C and a plurality of notches or slots 112A defined within the bottom surface 102D of the face panel 102. Additionally, or alternatively, the face panel can comprise a plurality of projections 120 extending outwardly from the bottom surface 102D and a plurality of notches or slots 112A defined within the top surface 102C of the face panel 102. In use, each notch or slot 112A can be configured to receive a corresponding projection of an adjacent face panel (upper or lower) when a retaining wall 300 is constructed as disclosed herein. Optionally, when the top or bottom surfaces 102C, 102D of the face panel 102 comprise both projections 120 and notches or slots 112A, it is contemplated that each slot of the face panel can be axially spaced from each projection of the face panel relative to the first axis 114.

Figure 13:
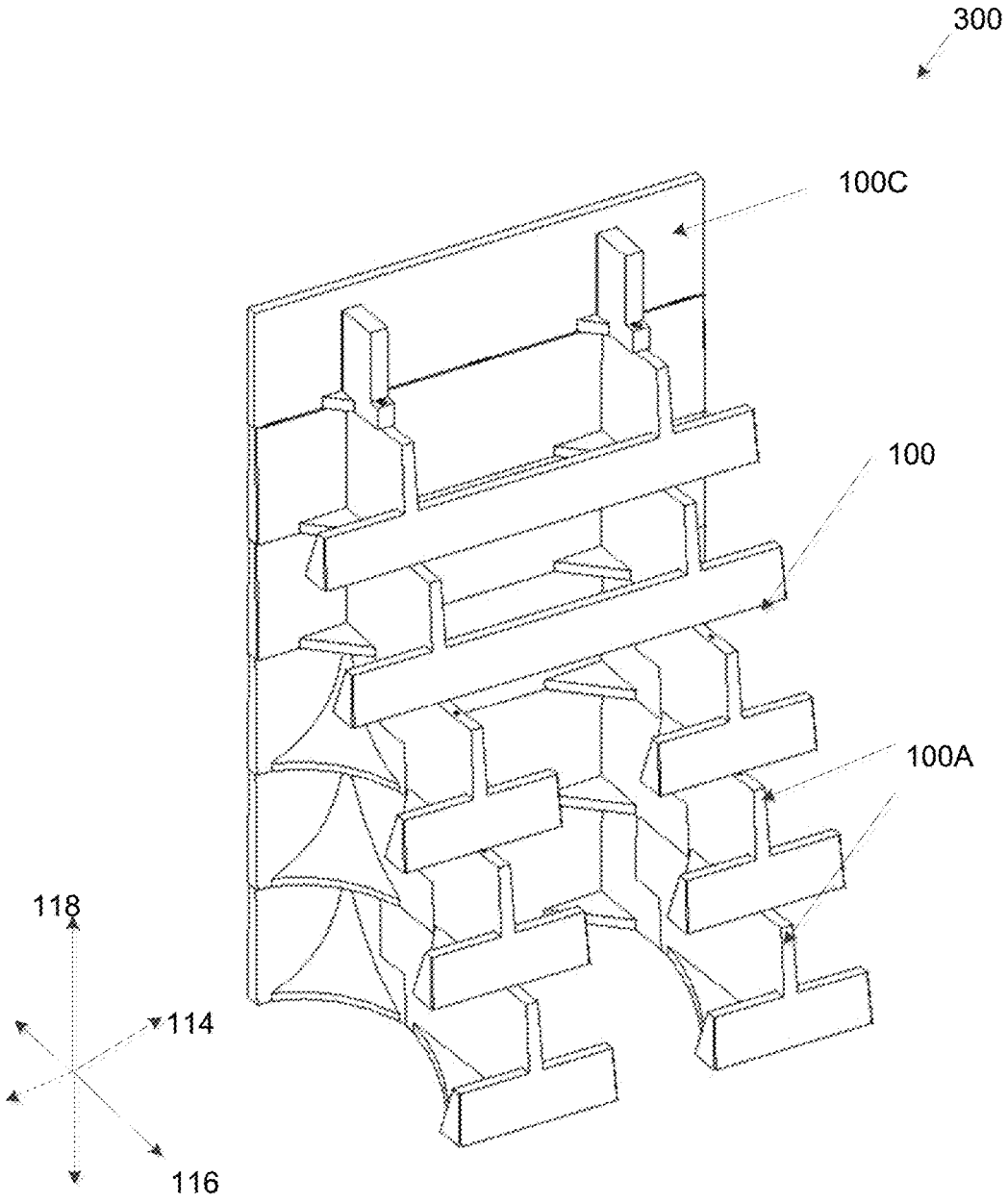
FIG. 13 is a rear perspective view of a retaining wall constructed of exemplary building elements as disclosed herein. As shown, a portion of the building elements have reinforcement wings with curved or arcuate profiles, while a second portion of the building elements have reinforcement wings with straight profiles. Additionally, the building elements have back sections of various constructions.

In use, it is contemplated that the projections 120 and notches or slots 112A can be used as engagement features to further stabilize the face panel 102. For example, engaging the face panels 102 of respective panels during retaining wall construction can reduce movement of the face panels along the second axis 116. Optionally, it is contemplated that the projections 120 can be oriented perpendicularly or substantially perpendicularly to the first plane (and extend parallel or substantially parallel relative to the third axis 118). In a further aspect, a portion of the top or bottom surface of the face panel can be coplanar of the first plane comprising the first axis 114 and the second axis 116. Optionally, in exemplary aspects, and as shown in FIG. 1, the projections 120 can comprise a base surface 120B coupled to the top surface 102C or bottom surface 102D of the panel 102 and an apex or apex surface 120A that is spaced outwardly from the base surface 120B relative to the third axis 118. For example, it is contemplated that the projection 120 can optionally comprise a pyramid or dome type structure, with the apex 120A corresponding to the minimal diameter portion of the projection and the base surface 120B corresponding to the maximal diameter portion of the projection. In yet another example, the projection 120 can define an apex surface 120A as opposed to a true apex, such as a tip. In this example, it is contemplated that a variety of shapes for the projection are possible, including, for example and without limitation, a rhomboid shape, a conical frustum, a rectangular prism, a cylinder, and the like. During the construction of a face panel 102 comprising a projection 120 or a notch or slot that is configured to receive a projection, a mold can be formed to have a corresponding indentation that defines a projection 120 in one or more surfaces of a face panel as disclosed herein. Similarly, it is contemplated that the mold can define a projection or protrusion that is configured to form a notch a slot in one or more surfaces of a face panel as disclosed herein. In use, the projection 120 can be configured to increase the stability of the retaining wall when building elements 100 are stacked upon each other. For example, in another aspect, as shown in FIG. 13, a notch, slot, or other alignment void 112 can be defined by a top surface 102C or bottom surface 102D of the face panel 102, and each alignment void 112 can be configured to receive a corresponding projection 120 as disclosed herein.

As discussed earlier, the building element 100 can comprise a beam member 104, which can comprise a length dimension oriented along the second axis 116, a width dimension oriented along the first axis 114, and a height dimension oriented along the third axis 118. In exemplary aspects, the beam member 104 can comprise a brace section 106 that is mechanically coupled or secured to the rear surface 1026 of the face panel 102. Optionally, it is contemplated that at least a portion of the beam member can be integrally formed with the face panel 102. In further aspects, the beam member 104 can comprise a back section 108 that has a length dimension along the first axis 114 such that it is perpendicular or substantially perpendicular to the brace section 106. Optionally, it is contemplated that the back section 108 can be integrally formed with a rear portion of the brace section 106. Alternatively, it is contemplated that the brace section 106 and the back section 108 can be formed separately and mechanically coupled or attached.

Figure 2:
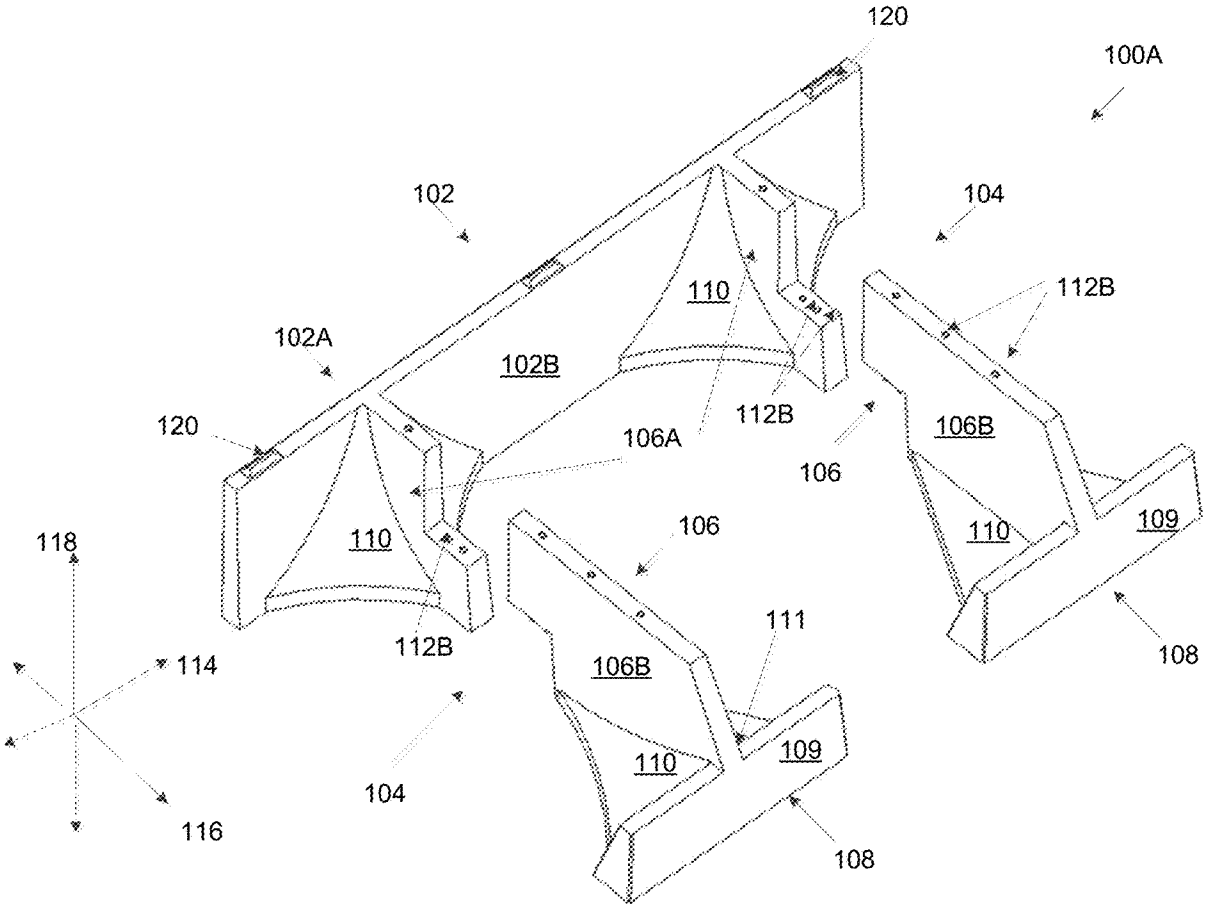
FIG. 2 is a rear perspective view of an exemplary modular building element having a plurality of beam members as disclosed herein.
Figure 3:
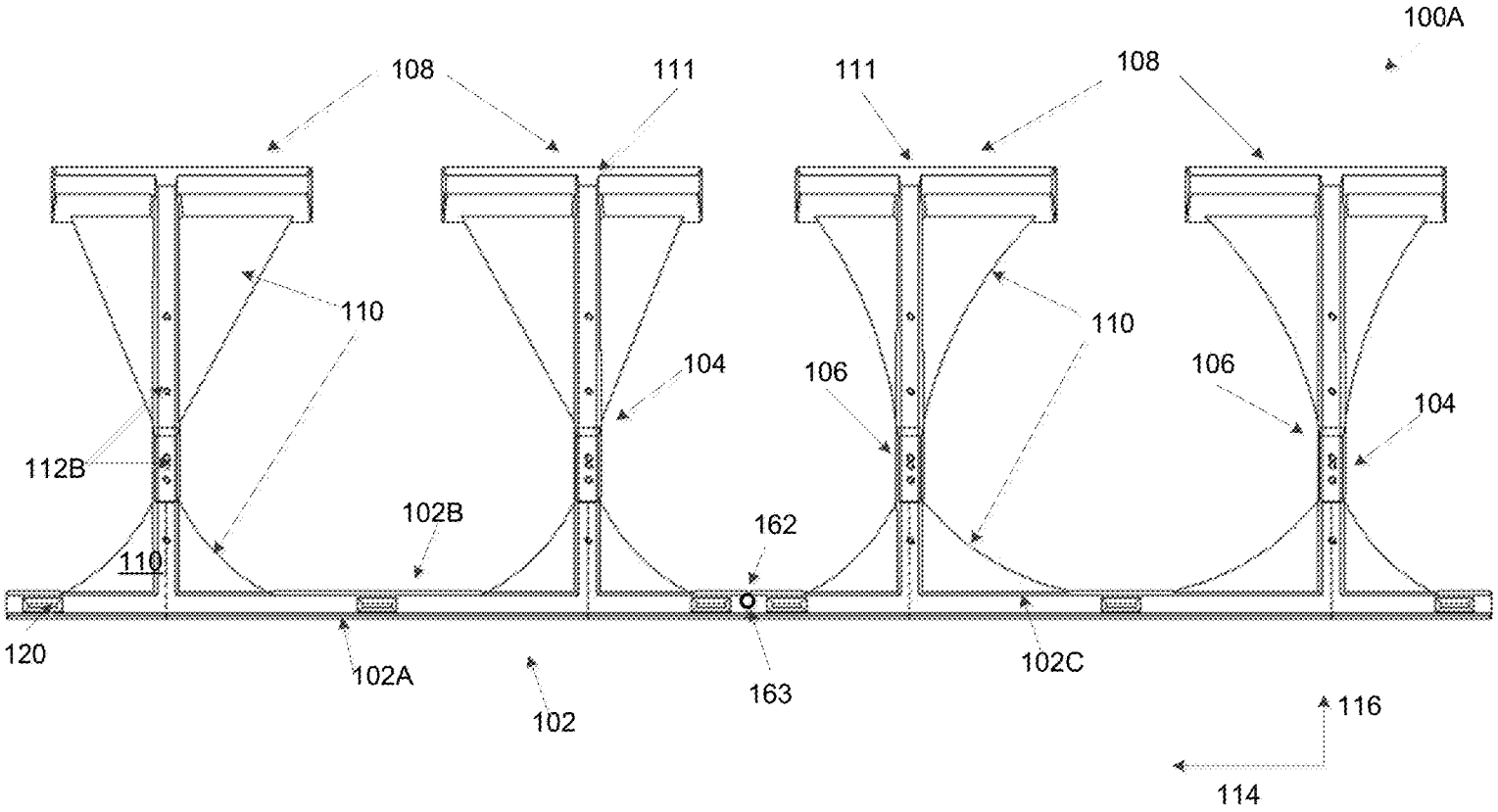
FIG. 3 is a top view of a plurality of building elements with reinforcement wings of varying dimensions and varying cross sectional areas.

Optionally, as shown in FIGS. 1-2, it is contemplated that the back section 108 can have a trapezoidal cross-sectional shape, although alternative shapes are possible. In general, the length dimension of the brace section 106 and length dimension of the back section 108 are perpendicular with respect to one another to provide stability and balance. In an aspect, the back section 108 can have a length dimension ranging from about 4 ft. to about 30 ft., from about 6 ft. to about 20 ft., or from about 7 ft. to about 10 ft. Optionally, the back section can have a length dimension of about 8 ft. It is further contemplated that the dimensions of the face panel 102, beam member 104 and back section 108 can further vary to accommodate the mode of transportation. More particularly, it is contemplated that the length dimensions of the face panel 102, beam member 104, and back section 108 can be selected to maximize efficiency in shipment or transport. For example, during shipment of building elements 100 on a tractor trailer with a towing bed length of 50 to 55 feet, it is contemplated that the length dimensions of the face panel 102, the beam member 104, and the back section 108 can be selected such that the length dimension of the beam member does not exceed the width of the towing bed and the length dimensions of the face panel 102 and the back section 108 are sufficiently small that the towing bed can accommodate at least two building elements along its length.

As depicted in FIG. 1, a top surface of the brace section 106 extends higher along the third axis 118 than the top surface of the back section 108. In addition, the trapezoidal cross section of the back section 108 can comprise a back surface 109 oriented at an angle relative to the third axis 118. In a further aspect, this back surface 109 can be coplanar or substantially coplanar with a rear surface 106C of the beam member. The angled orientation of surfaces 109 and 106C, in addition to the top surface of the back section 108, can define an engagement surface for engagement with the extension element 200 depicted in FIG. 8 and further described herein.

Referring to FIGS. 3-6, the length dimension of the back section 108 can be divided at a coupling junction 111 positioned at the intersection of the back section and the brace section 106. As depicted, it is contemplated that the back portion 108 can be asymmetric relative to the coupling junction 111, with unequal lengths of the back portion positioned on opposing sides of the coupling junction. Alternatively, the back portion 108 can be symmetric relative to the coupling junction 111, with equal or substantially equal lengths of the back portion positioned on opposing sides of the coupling junction. The symmetry or asymmetry of the back section 108 relative to the coupling junction 111 can be adjusted to account for variations in the underlying earth. Similarly, it is contemplated that the front panel of each building element can either be symmetric or asymmetric relative to the junction between the beam member and the front panel.

In an aspect, the beam member 104 can have a length dimension ranging from about 3 ft. to about 14 ft., from about 4 ft. to about 12 ft., or from about 5 ft. to about 10 ft. Optionally, the beam member can have a length dimension of about 8 ft. In an aspect, the beam member 104 can have a height dimension ranging from about 3 ft. to about 9 ft., from about 4 ft. to about 8 ft., or from about 5 ft. to about 7 ft. Optionally, the beam member 104 can have a height dimension of about 6 ft. In a further aspect, the beam member 104 can have a width dimension ranging from about 3 in. to about 9 in., from about 4 in to about 8 in., or from about 5 in. to about 7 in. Optionally, the beam member 104 can have a width of about 6 in.

In various aspects, and with reference to FIGS. 3-6, each building element 100 can further comprise at least one reinforcement wing 110. In these aspects, each reinforcement wing 110 can comprise a member that strengthens the coupling between the beam member 104 and either the face panel 102 or the back portion 108. Functionally, the reinforcement wing 110 can increase structural integrity of the building element 100 by preventing the face panel 102 or the back portion 108 from being bent by internal earth load pressures. Structurally, a reinforcement wing 110 can be operably coupled or secured to the rear surface 1026 of the face panel 102 and a side surface of the brace section 106 of the beam member 104. Similarly, it is contemplated that a reinforcement wing 110 can be operably coupled or secured to a front surface of back portion 108 and a side surface of the brace section 106 of the beam member. In exemplary aspects, reinforcement wings can be provided in pairs, with a first reinforcement wing 110 positioned on a first side of the beam 104 relative to first axis 114 and a second reinforcement wing 110 positioned on a second, opposite side of the beam relative to the first axis, thereby providing additional stability. For example, the at least one reinforcement wing can comprise a first pair of reinforcement wings that extend, respectively, from opposite sides of the beam 104 to contact portions of the face panel 102 or the back portion 108 that are positioned on opposing sides of the beam relative to the first axis 114. Optionally, it is contemplated that the at least one reinforcement wing 110 can comprise first and second pairs of reinforcement wings, with a first pair of reinforcement wings extending, respectively, from opposite sides of the beam 104 to contact portions of the face panel 102 that are positioned on opposing sides of the beam relative to the first axis 114, and with a second pair of reinforcement wings extending, respectively, from opposite sides of the beam 104 to contact portions of the back portion 108 that are positioned on opposing sides of the beam relative to the first axis 114.

In exemplary aspects, it is contemplated that the reinforcement wings of each pair of reinforcement wings can be symmetrical relative to the beam 104. However, in other exemplary aspects and as shown in FIGS. 3-6, it is contemplated that the reinforcement wings of each pair of reinforcement wings can be asymmetrical relative to the beam 104. In various aspects, it is contemplated that each reinforcement wing 110 can have a width dimension relative to the first axis 114 and a length dimension relative to the second axis 116. Optionally, in these aspects, the reinforcement wings of a pair of reinforcement wings can have different width dimensions while maintaining substantially equal length dimensions. In further exemplary aspects, when the reinforcement wings of a pair of reinforcement wings have curved or arcuate side surfaces that define a curve or arc within the primary plane, it is contemplated that each side surface can have a respective radius of curvature. Optionally, in these aspects, the side surfaces of the reinforcement wings of the pair of reinforcement wings can have an equal radius of curvature; alternatively, in asymmetrical configurations, it is contemplated that the side surfaces of the reinforcement wings can have different radii of curvature.

Figure 4:
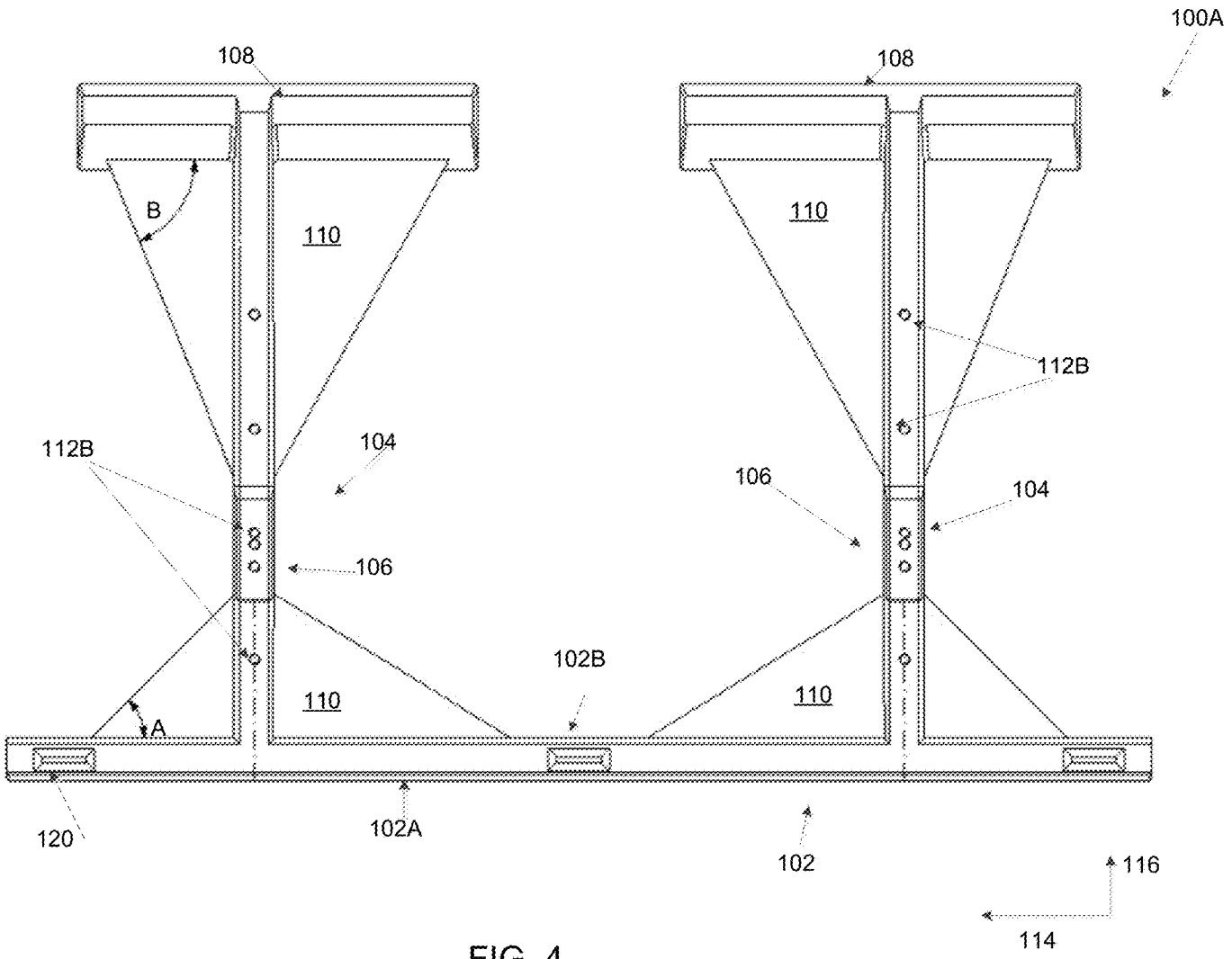
FIGS. 4-6 are close-up top views of a plurality of building elements with reinforcement wings of varying dimensions and varying cross sectional areas.
Figure 5:
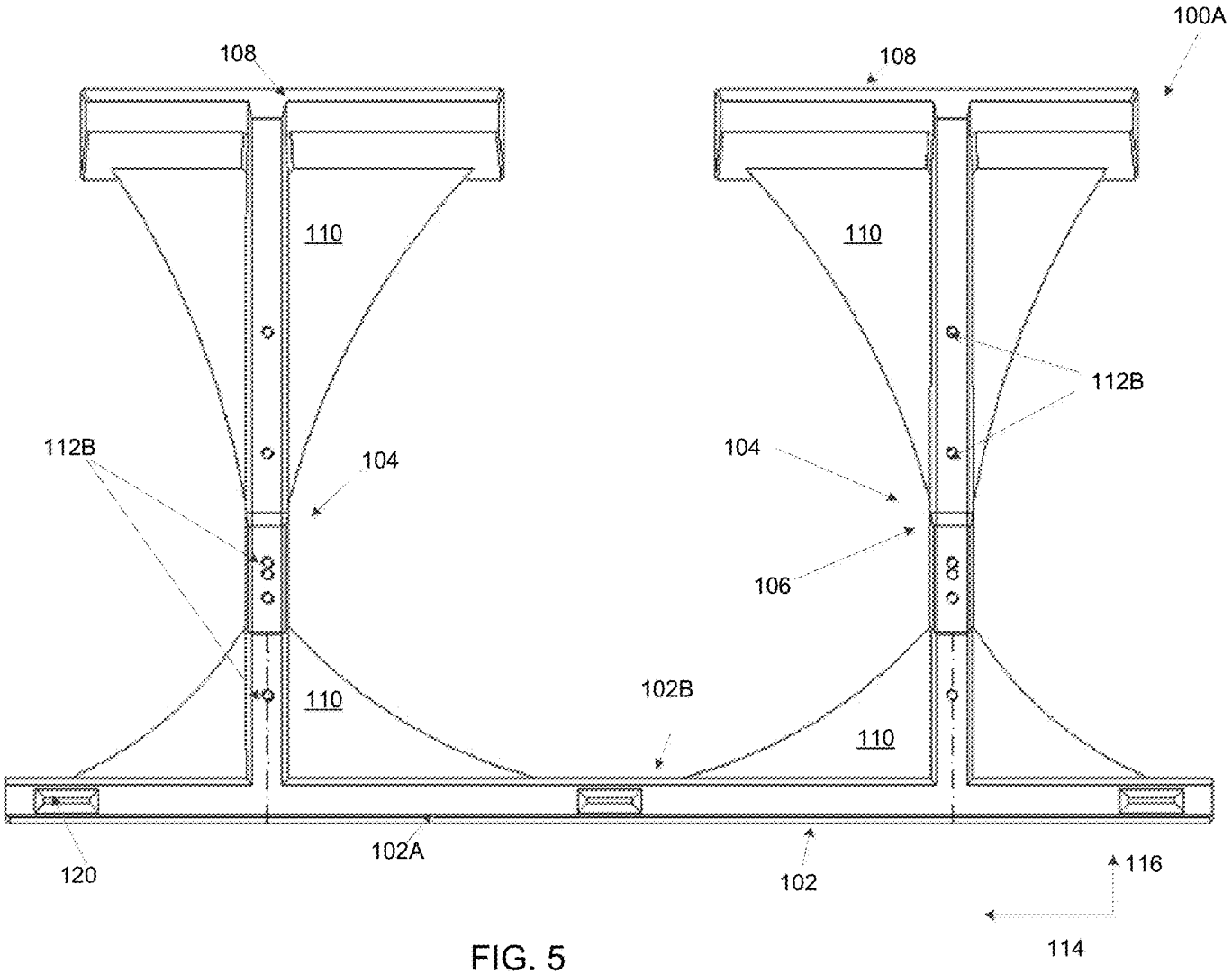
Figure 6:
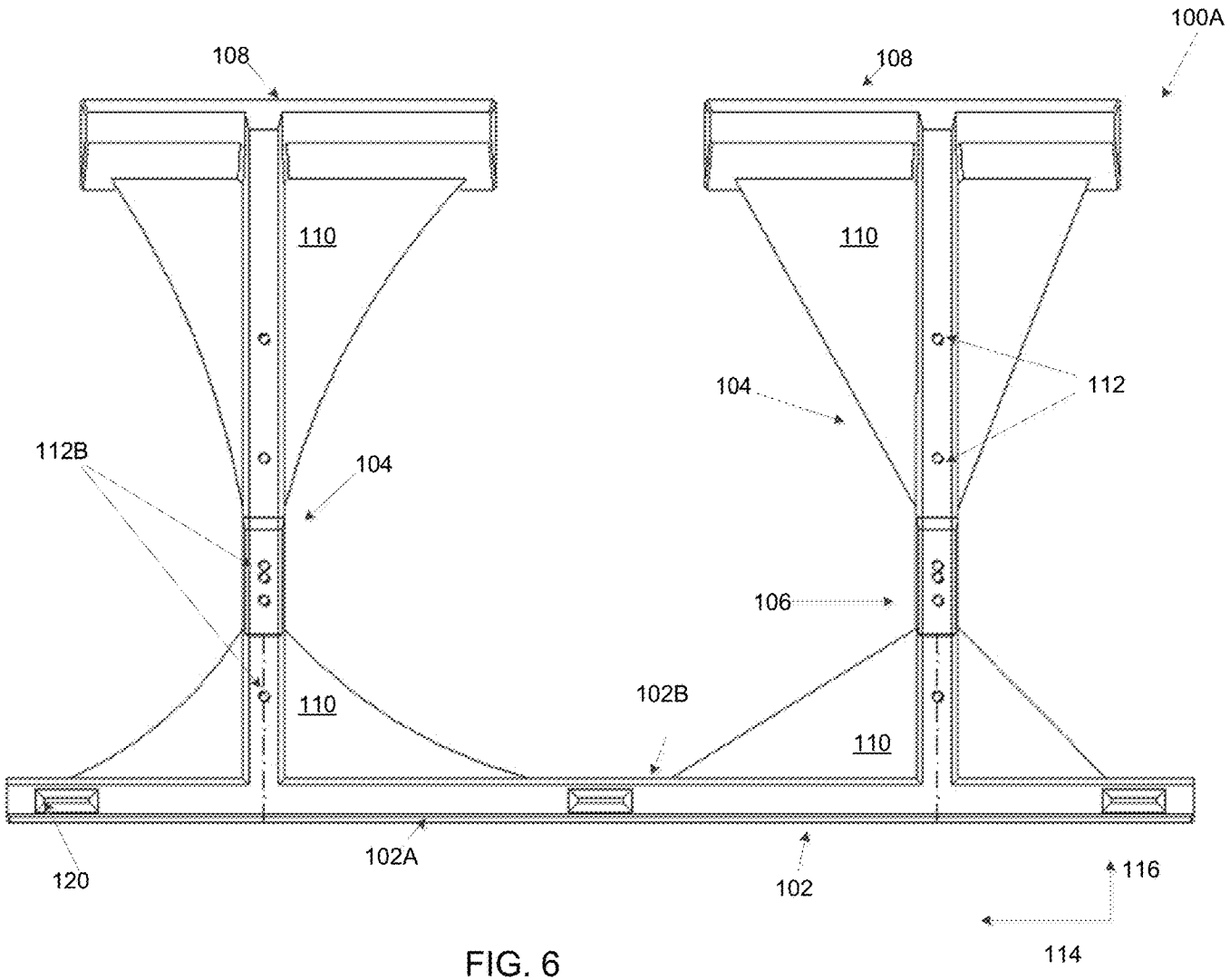
Figure 7:
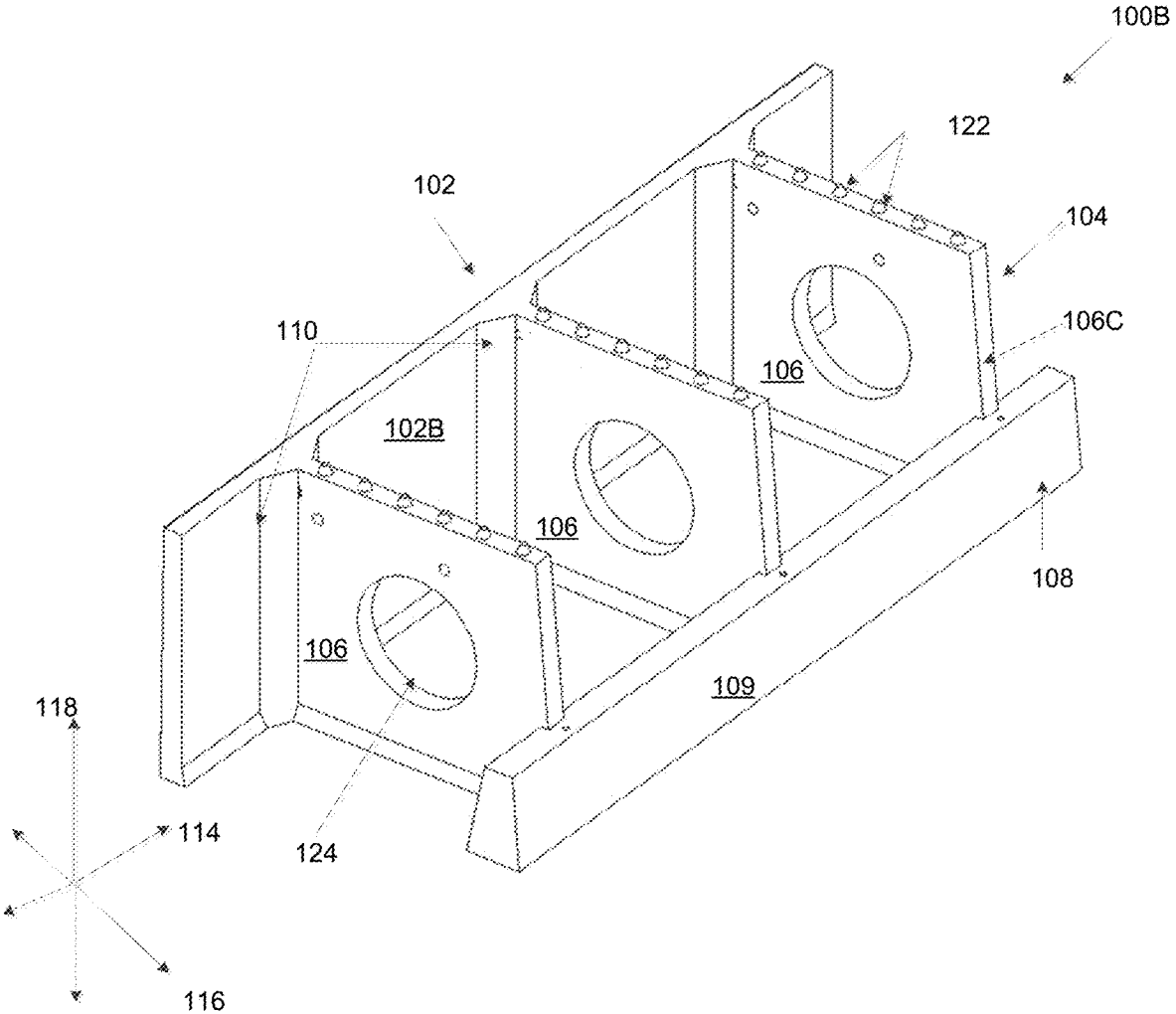
FIG. 7 is a rear perspective view of an exemplary building element having a plurality of beam elements that define apertures as disclosed herein.
Figure 9:
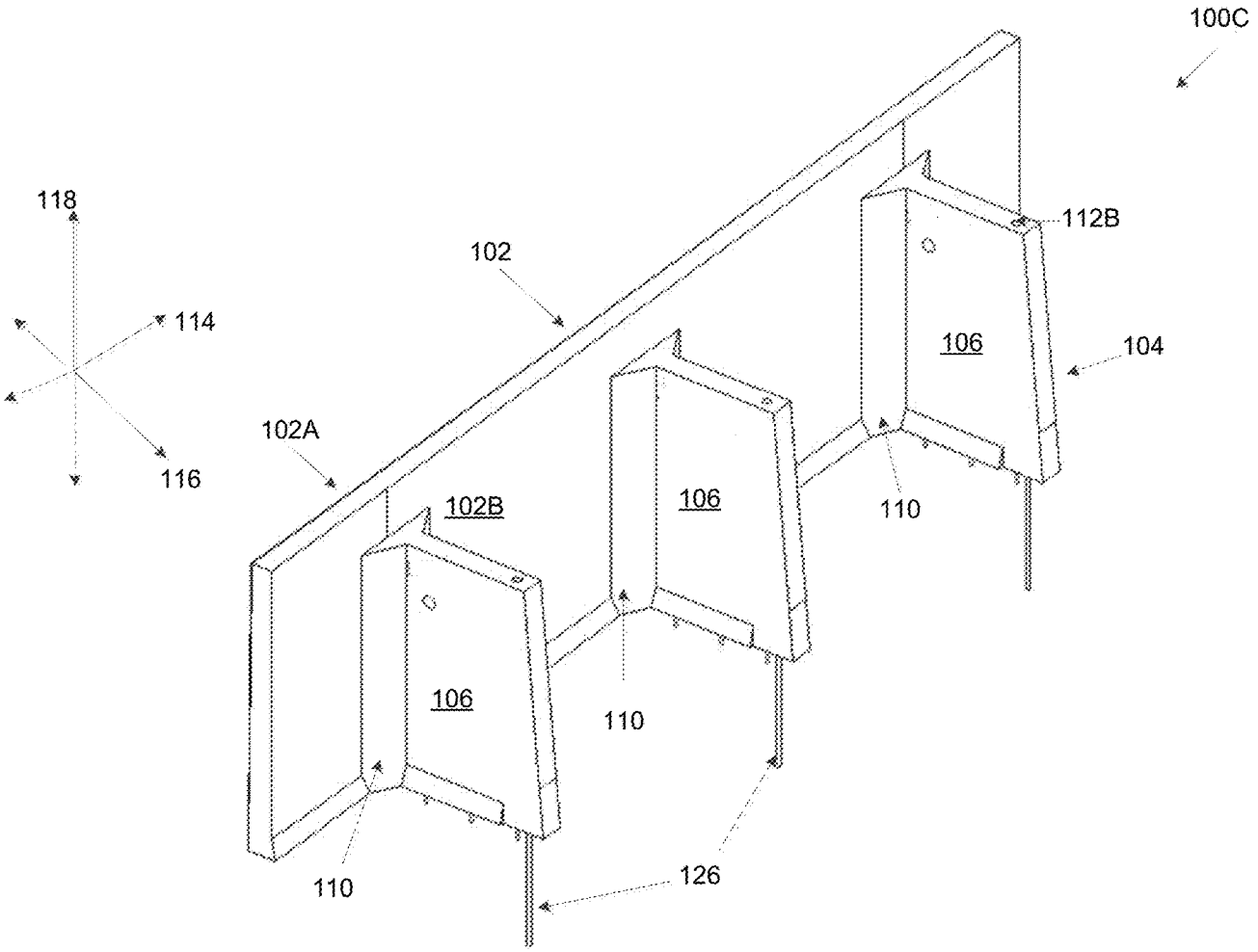
FIG. 9 is a rear perspective view of an exemplary building element having beam elements with securing rods as disclosed herein.

Optionally, each reinforcement wing can have a triangular shape; however, other geometric shapes are possible. For example, as shown in FIGS. 1 and 2, the reinforcement wings 110 extending between the beam 104 and the face panel 102 can have an arcuate profile with a variable cross-sectional area relative to the third axis 118, such as an arcuate profile including a curved or arcuate side surface (e.g., a concave side surface) and a curved or arcuate upper surface (e.g., a concave upper surface), which can optionally extend upwardly from the side surface and taper inwardly until reaching the top surfaces of the face panel and the beam at the junction between the face panel and the beam. In other examples, it is contemplated that the reinforcement wings 110 can define planar upper and lower surfaces and have a side surface that extends between the upper and lower surfaces and has either a straight orientation or a curved or arcuate orientation. In another aspect, as shown in FIGS. 7 and 9, each reinforcement wing can comprise a triangular prism that extends along the height dimension of the beam and has a uniform cross sectional area along the third axis 118. As shown in FIGS. 4-6, the respective top views of the reinforcement wings 110 demonstrate a variety of triangular or arcuate profiles that can be used. In a further aspect, when a side surface of a reinforcement member extending from the beam to the back portion has a straight orientation (defining a reinforcement member with a generally triangular shape), it is contemplated that the side surface can define an angle A relative to first axis 114. Similarly, when a side surface of a reinforcement member extending from the beam to the face panel has a straight orientation (defining a reinforcement member with a generally triangular shape), it is contemplated that the side surface can define an angle B relative to first axis 114. For example, the angle A or B of reinforcement wings 110 can range between about 30 degrees and about 75 degrees, between about 45 degrees and about 60 degrees, or between about 50 degrees and about 55 degrees. Optionally, the angles A or B can be about 45 degrees.

Exemplary Building Element Dimensions

In an aspect, the face panel 102 can have a length dimension ranging from about 26 ft. to about 18 ft., from about 24 ft. to about 20 ft., or from about 23 ft. to about 21 ft. Optionally, the face panel can have a length dimension of about 22 ft. In an aspect, the face panel can have a height dimension ranging from about 9 ft. to about 3 ft., from about 8 ft. to about 4 ft., or from about 7 ft. to about 5 ft. Optionally, the face panel can have a height dimension of about 6 ft. In a further aspect, the face panel can have a width dimension ranging from about 9 in. to about 3 in., from about 8 in. to about 4 in. or from about 7 in. to about 5 in. Optionally, the face panel can have a width of about 6 in. In a further aspect, the face panel can have a surface area defined by the length and height dimension ranging from about 235 sq. ft to about 54 sq. ft, from about 192 sq. ft to about 80 sq. ft, or from about 161 sq. ft to about 105 sq. ft. Optionally, the face panel 102 can have a surface area of about 132 sq. ft. It is further contemplated that the size of the face panel in this disclosure can be about 3.3 to about 16 times larger than traditional building elements where the respective panels range from 8 sq. ft. to 40 sq. ft. It is also further contemplated that the size of the disclosed building elements 100A-C and 200 can increase the efficiency in building a retaining wall, by allowing for quicker wall construction and a reduction in the number of wall components needed to complete a wall assembly. The size of the building elements can also increase the structural integrity of a wall 300 as compared to traditional building elements.

Building Elements Having Beam Members with Detachable Brace Portions

In exemplary aspects, and with reference to FIGS. 1-6, 12, and 15, the brace section 106 of the beam 104 can comprise a first portion 106A and a second portion 106B that is selectively attachable and detachable from the first portion 106A. As shown in FIG. 1, the first portion 106A of the brace section 106 can be mechanically coupled or secured to the rear surface 102B of the face panel 102. Optionally, it is contemplated that the first portion 106A can be integrally formed with the face panel 102, such as, for example and without limitation, in a single molding process. In use, it is contemplated that the first portion 106A can be used with a variety of second portions 106B having different features, including, for example and without limitation, different lengths relative to the second axis 116, different constructions, different reinforcement wing arrangements, different back portion dimensions or structures, and the like. Similarly, it is contemplated that the second portion 106B can be used with a variety of first portions 106A having different features, including, for example and without limitation, different lengths relative to the second axis 116, different constructions, different reinforcement wing arrangements, different face panel dimensions or structures, and the like.

Figure 15:
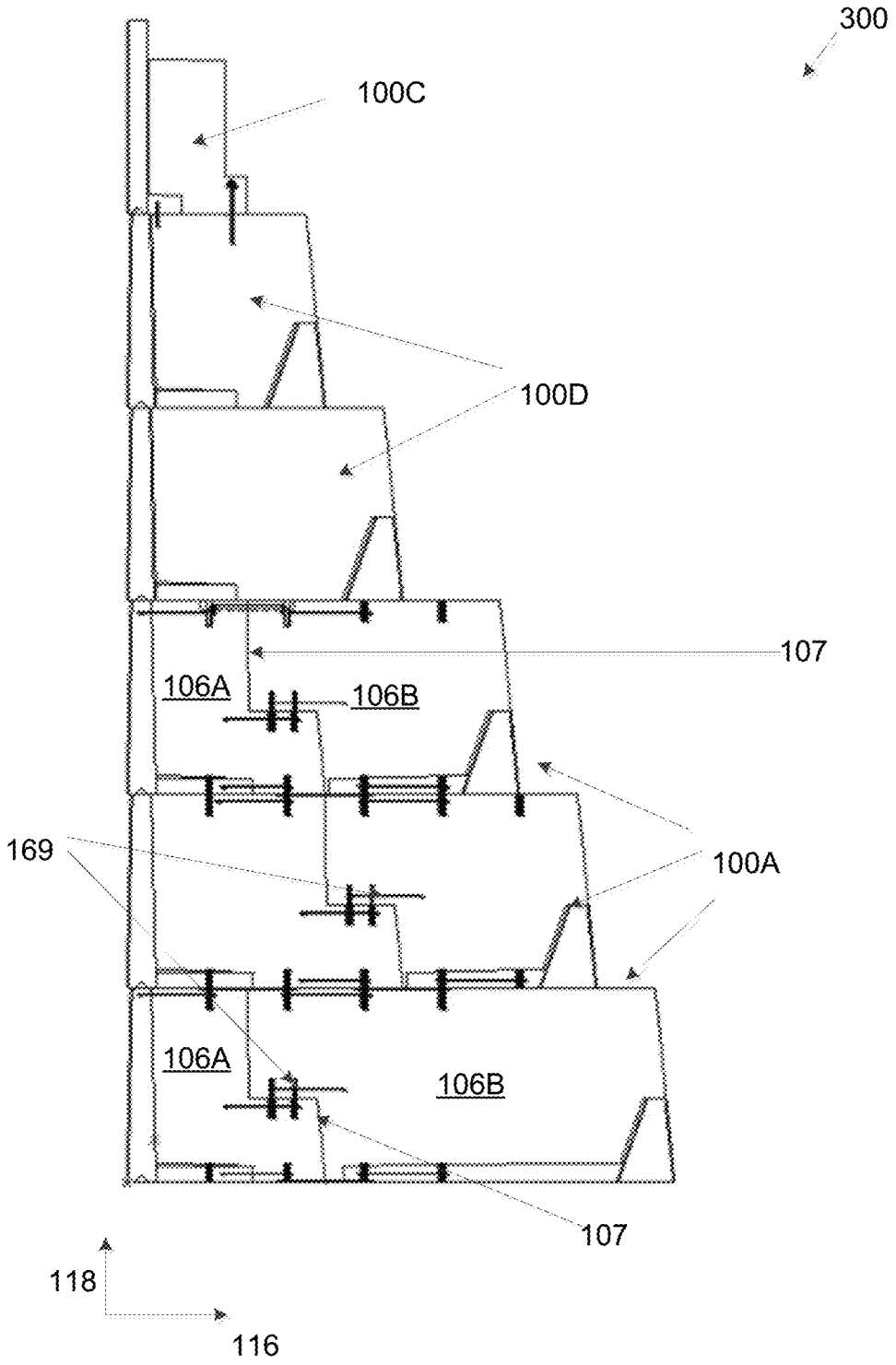
FIG. 15 is a cross-sectional side view of the retaining wall depicted in FIG. 14.

In erecting a retaining wall, it is contemplated that the modularity provided by the detachable portions of the brace section can provide increased variability in the length dimension of the beam member 104 and provide a builder with additional flexibility in building element configurations to account for variations in the earth. In exemplary aspects, as shown in FIGS. 12 and 15, the first and second portions 106A, 1066 of a brace section 106 can be securely attached to each other using at least one alignment post or securing rod 126 (optionally, a plurality of securing rods) as disclosed herein. Optionally, in these aspects, a front portion of the second portion 1066 of the brace section 106 can be configured to overlie a rear portion of the first portion 106A of the brace section to permit attachment of the second portion to the first portion. For example, as shown in FIGS. 1-2 and 12, the first portion 106A can have a variable height moving along the second axis 116, with the first portion having a rear portion with a reduced height that defines a recess for receiving and engaging the front portion of the second portion 106B, which in turn can define a complementary recess that receives the rear portion of the first portion. When engaged together, the first and second portions 106A, 106B can cooperate to define a brace section 106 having a consistent height relative to the third axis 118. Optionally, an upper surface of the rear portion of the first portion 106A can define at least one alignment void 1126 that is configured to receive a portion of an alignment post or securing rod 126 that extends downwardly from the front portion of the second portion 1066. In exemplary aspects, a plurality of securing rods 126 can span between the first and second portions 106A, 106B. In these aspects, it is contemplated that the securing rods 126 can be embedded within the second portion 106B. Alternatively, it is contemplated that the second portion 1066 can define respective alignment voids that receive portions of the securing rods such that a portion of each securing rod is received within respective alignment voids of both the first and second portions 106A, 1066. In a further aspect, a reinforcement bar 169 can be embedded within the second portion 106B of the brace section 106 and coupled to the securing rods 126. The reinforcement bar 169 can increase the alignment and stability of the securing rods when the securing rods 126 are engaged to alignment voids 1126 located at the joint 107 between the brace sections 106A, 1066.

Building Elements Having Beam Members that Define Horizontal Apertures

In another aspect, as depicted in FIG. 7, a surface of the brace section 106 can define an aperture 124 that surrounds an axis that is parallel to the first axis 114. The aperture 124 can be used as a conduit to allow backfill comprising filler materials to pass through the beam member and allow for more consistent filling during erection of the wall. In exemplary non-limiting aspects, the aperture can have a cross-sectional area ranging from about 1 sq. ft. to about 10 sq. ft., from about 2 sq. ft. to about 9 sq. ft. or from about 3 sq. ft. to about 8 sq. ft. Optionally, the cross sectional area can be about 5 sq. ft. The aperture 124 can also reduce cost and weight of the building element by reducing the amount of concrete needed to form the respective elements. The aperture can further provide additional engagement features to allow a crane or moving apparatus to grab the building element for transport. During erection of the wall, the apertures 124 can serve as conduits to pass utilities or communications lines and also allow for movement of workers among different sections of the wall assembly before filler materials have been delivered. The filler materials 166 can comprise earthen materials such as dirt, sand, gravel, rocks, sand, or the like. In use, the apertures 124 can help the building element maintain consistent contact with the filler material 166, thereby providing increased stability.

As shown in FIG. 7, the building element 100B can also comprise an alignment post 122, which can extend downwardly from the building element 100B and function in a similar manner to projections 120.

Extension Elements

Figure 8:
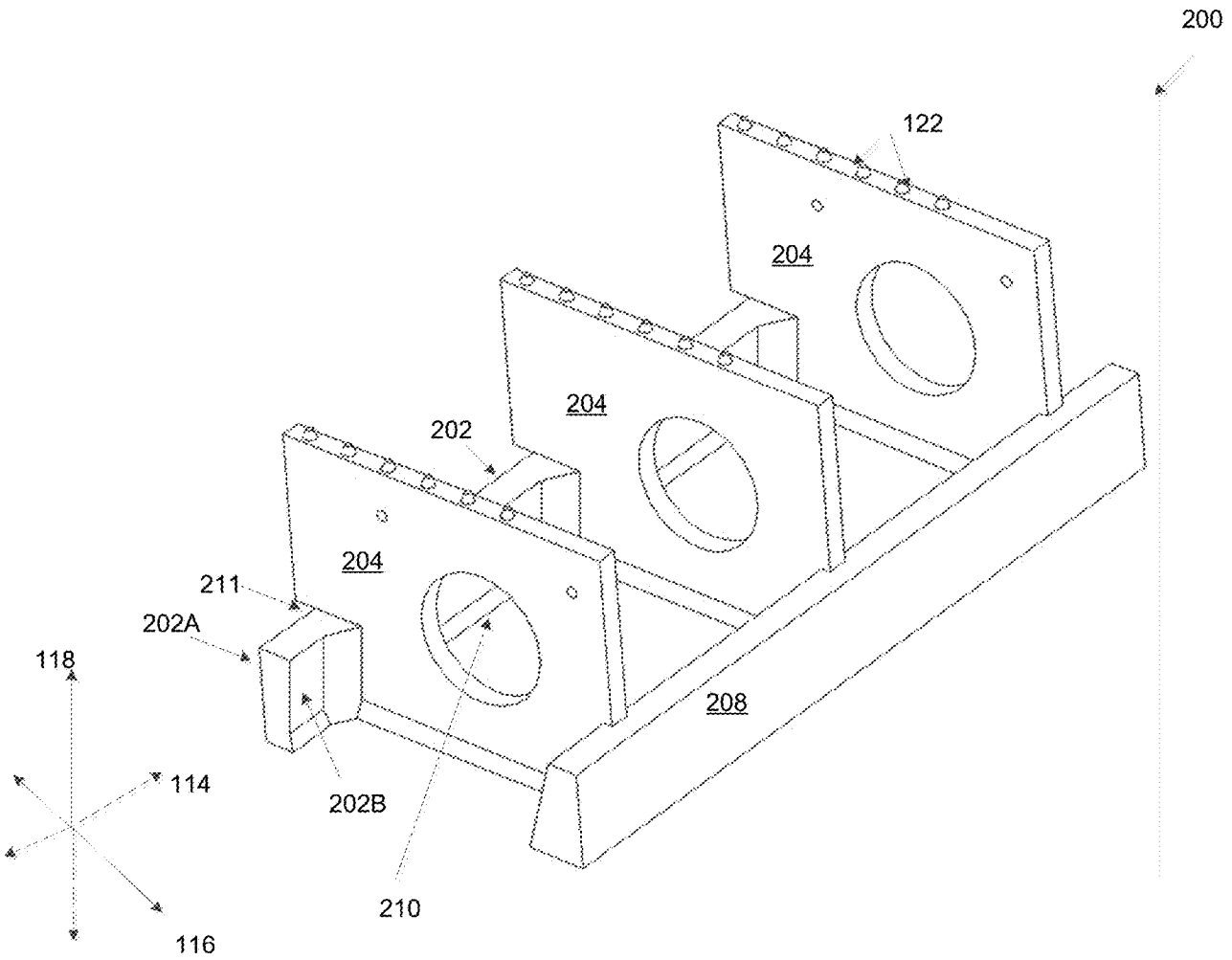
FIG. 8 is a rear perspective view of an exemplary extension element that is configured for connection to a building element as disclosed herein.

As shown in FIG. 8, an extension element 200 can be configured to be coupled to the exemplary building element 100B in FIG. 7. The extension element 200 can be configured to align and reinforce the stability of building element 100B. In particular, the beam members 204 can be aligned with the beam members 104 of the building element 100. In addition, a front surface 202A of the face panel 202 of the extension element 200 can serve as a mating panel to the rear surface 109 of building element 100B. Abutting the extension element 200 with the building element 1006 can increase the stability of the resulting wall by increasing the distance from the face panel 102 along the second axis 116. In a further aspect, the beam member 204 can overlap the face panel 202 along the length dimension of the beam member 204 (relative to the second axis 116). The overlap portion 211 of the beam member 204 can rest on a top surface of the back member 108 of building element 1006 while the front surface 202A can abut against the slanted surface defined by the rear surfaces 106C of the brace section and the rear surface 109 of the back section. In a further aspect, the beam member 104 and the beam member 204 can be collinear or substantially collinear along the length dimension along the second axis 114. In yet a further aspect, the extension element 200 can also have alignment posts 112 and corresponding alignment voids, which can be configured to extend along the third axis 118 when in use. In an aspect, the extension member 200 can have a length dimension relative to the second axis 116 ranging from about 2 ft. to about 8 ft., from about 3 ft. to about 7 ft., or from about 4 ft. to about 6 ft. Optionally, the extension member 200 can have a length dimension of about 4 ft.

In exemplary aspects, it is contemplated that the extension beam elements 204 can define apertures 210 that function in the same way as, and are similarly dimensioned to, the apertures 124 of the beam members 104 of building element 1006.

Alignment Posts

Figure 10:
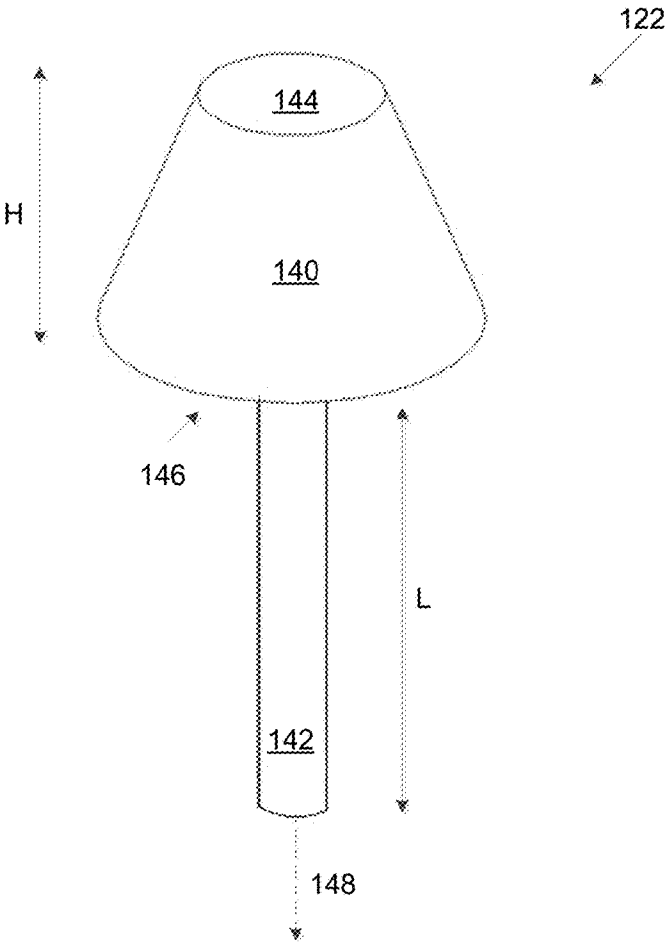
FIG. 10 is an isometric view of an exemplary alignment post as disclosed herein.
Figure 11:
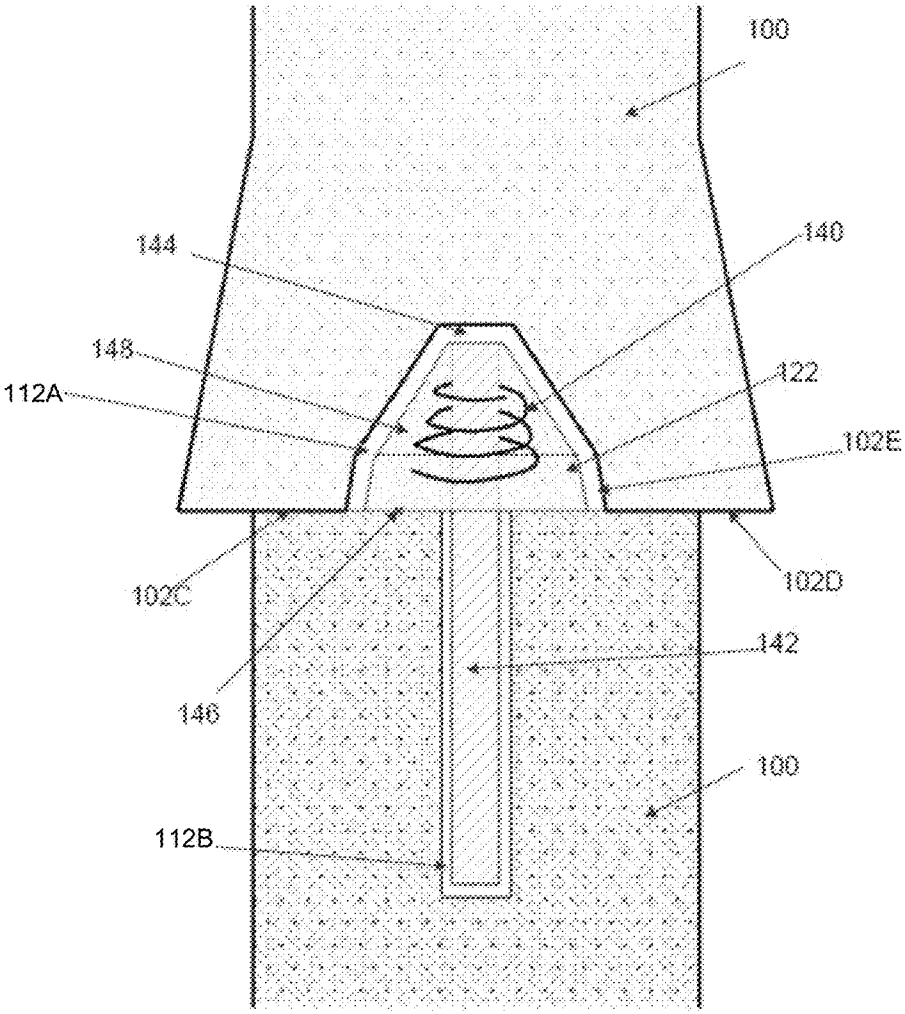
FIG. 11 is a cross-sectional end view of an exemplary engagement between the beam elements of two adjacent (vertically stacked) building elements with an alignment post as disclosed herein.

FIG. 10 depicts an exemplary aspect of an alignment post 122. The alignment post 122 can comprise two components, a stem 142 and a cap 140. During construction of the alignment post 122, the stem 142 can be inserted into a mold filled with a setting material to form the cap 140. The setting material can be concrete or the like. The cap 140 can comprise a height dimension H that is associated with the amount of the cap that will be received within an alignment void 112 of another building element 100 during erection of a retaining wall as disclosed herein.

In a further aspect, the cap 140 can be shaped like a frustum having a top surface 144 and a bottom surface 146. The stem 142 can comprise a stem axis 148 oriented along a length dimension L of the stem 142. In another aspect, the stem axis 148 can be perpendicular or substantially perpendicular to a portion of the bottom surface 146 of the cap 142. The bottom surface 146 of the cap 140 can abut the top surface of the beam. In a further aspect, the portion of the stem extending downardly from the bottom surface of the cap 140 can have a length L ranging from about 3 in. to about 10 in., from about 4 in. to about 8 in. or from about 5 in. to about 7 in. Optionally, the length (L) of the exposed stem portion can be about 5 in. In a further aspect, the width of the stem 142 can range from about 1 in. to about 3 in., from about 1.25 in. to about 2.75 in. or from about 1.5 in. to about 2.5 in. Optionally, the width of the stem can be 2.5 in. In a further aspect, the height H of the cap 140 can range from about 1.75 in. to about 3.25 in., from about 2.0 in. to about 3.0 in. or from about 2.25 in. to about 2.75 in. Optionally, the height of the cap can be about 2.5 in. In a further aspect, the width (outer diameter) of the base 146 of the cap 140 can range from about 1.75 in. to about 3.25 in., from about 2.0 in. to about 3.0 in. or from about 2.25 in. to about 2.75 in. Optionally, the width of the base of the cap can be about 2.8 in.

Optionally, when the alignment post 122 is engaged to the alignment void, there can be a clearance space of 0.25 in. between an inner surface 102E that defines the alignment void 112 and the outer surface of the cap 140.

As shown in FIG. 10, in a further aspect, the cap 142 can be strengthened using reinforcement material 149 such as a metal or plastic material embedded within the setting material. During erection of a retaining wall system, the alignment post 122 can be placed in the alignment void 112 defined by a surface of a respective beam member of a building element 100. As the stem 140 is set within the alignment void 112 of the respective beam member 104 the cap 142 will be the portion of the alignment post 122 protruding away from the surface of the beam 104.

In an alternative aspect, the stem 140 can comprise multiple materials. For example, an outer layer that circumscribes the stem axis 148 can comprise a plastic material such as polyethylene. An inner material for the stem 148 can be a metal bar that serves as a reinforcement of the plastic outer layer.

Securing Rods

Figure 16:
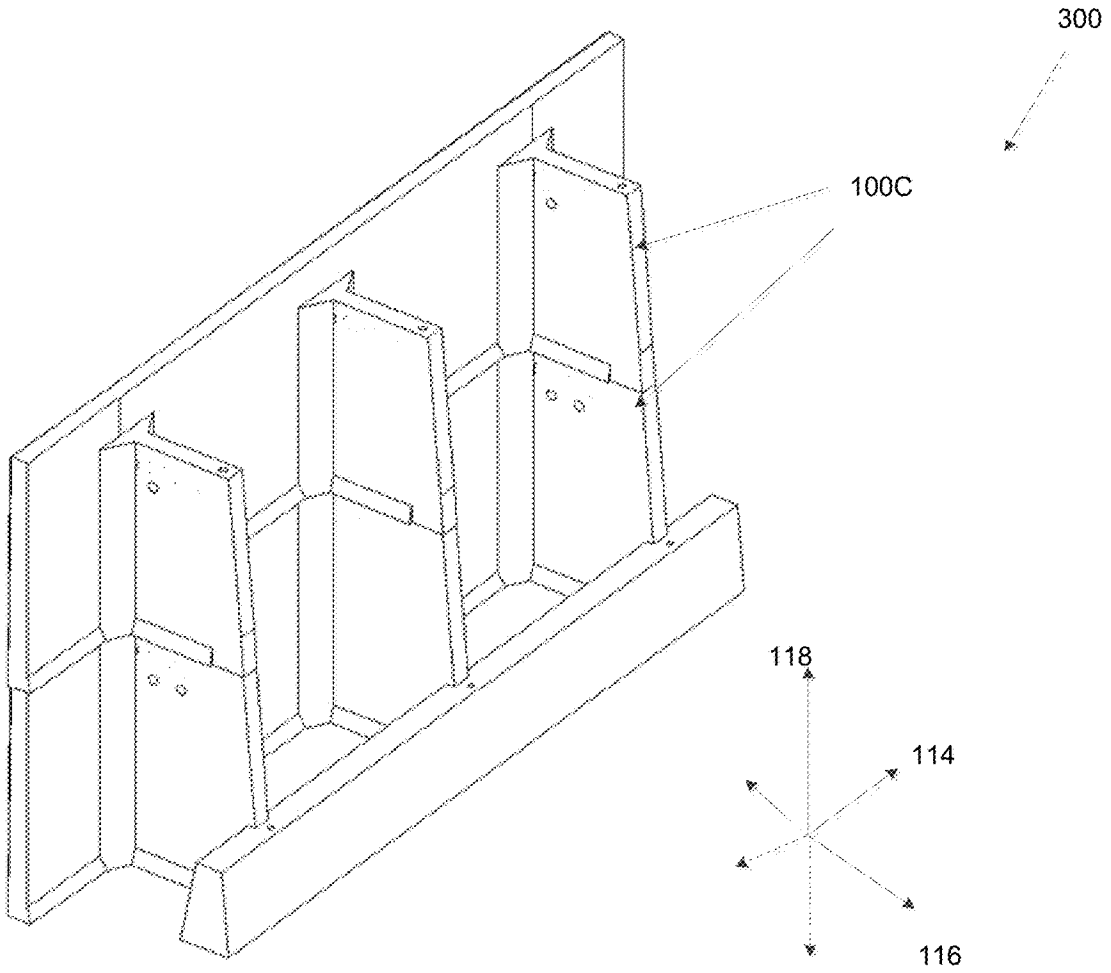
FIG. 16 is a rear perspective view of a retaining wall constructed of exemplary building elements as disclosed herein.

FIG. 9 depicts another exemplary embodiment of a building element 100C, which comprises a securing rod 126 extending away from a top or bottom surface 102C, 102D of the building element. The beam member can also comprise an alignment void 112. As shown in FIG. 16, the securing rod 126 as well as the alignment void 112 can be configured to be engaged as further disclosed herein such that a plurality of building elements 100C can be stacked upon each other. Again, the engagement between the securing rod 126 (and alignment posts) and their corresponding alignment voids 112 can allow the building element 100C to have increased stability by securing a connection between the two respective building elements. In a further aspect, building element 100C can serve as the top building element in a retaining wall as further disclosed herein. In a further aspect, the height dimension of the face panel 102 is less than the height dimension of the beam member 104.

Retaining Wall Systems

As shown in FIG. 12, depicts a side view of building element 100A. As further disclosed herein, the brace section can be detachable into first portion 106A and second portion 106B. In a further aspect, the first portion 106A can be coupled (e.g., secured) to the face panel 102 and the second portion 1066 can be detachably coupled to the first portion at a joint 107. In a further aspect, as disclosed herein, the first portion 106A and the second portion 106B can be coupled using securing rods 126. For example, a securing rod 126 can be a dowel, pin, or piece of rebar that is inserted to properly align the first and second portions 106A, 1066 of the brace section of the beam member 104. In another exemplary aspect, the upper surfaces of the first and second portions 106A, 1066 can define respective slots or recesses (alignment voids) that are configured to receive opposing end portions of a U-bar 150 as shown in FIG. 12. In this aspect, the respective alignment voids can be axially spaced relative to the second axis 116.

Figure 14:
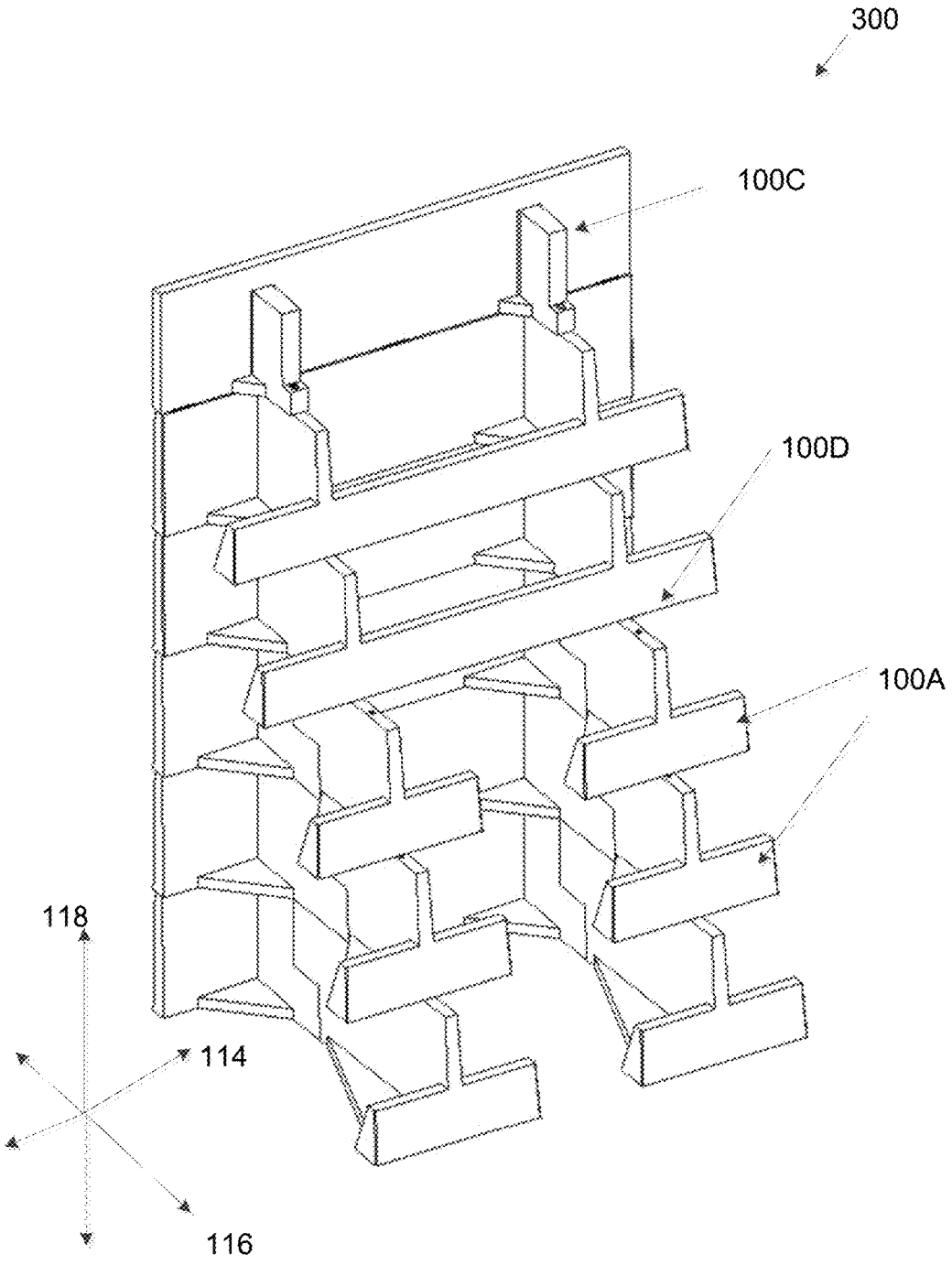
FIG. 14 is a rear perspective view of a retaining wall constructed of exemplary building elements.

FIGS. 13-15 depict an exemplary retaining wall 300 structure comprising a plurality of building elements. In an aspect, the retaining wall can comprise a combination of various types of building elements disclosed herein. It is contemplated that the retaining walls 300 can comprise a combination of one or more building elements 100A-E and/or an extension element 200 as disclosed herein. In a further aspect, as shown in FIG. 15, upon assembly of a plurality of building elements 100A as disclosed herein to form a retaining wall, it is contemplated that the joints 107 of adjacent building elements 100A are not vertically aligned. Optionally, in some exemplary aspects, it is contemplated that no joint 107 of any building element 100A will be vertically aligned with the joint 107 of any other building element 100A. For example, the joints 107 that occur at the intersection between the first and second portions 106A, 1066 of the brace sections can be offset by at least 1 foot along the second axis 116. Offsetting the joint 107 across different layers of the wall can produce a staggered configuration that reduces the stress points in the wall. In a further aspect, staggering the joint 107 locations can reduce the potential of a fault line that runs through the layers of the wall. As also depicted, alignment voids can be located at different sections of the beam member 104 and face panel 102 to insure that the variable configurations of the building elements can still be secured together. As depicted, the top layer of a retaining wall can comprise a building element 100C.

As shown in FIG. 16, the securing rod 126 as well as the alignment void 112 can be configured to be engaged such that a plurality of building elements 100C can be stacked upon each other. Again, the combination of engagement between the securing rod 126 and alignment notches 120 with the alignment void 112 allows the building elements 100 to have increased stability by securing a connection between the two respective building elements. In a further aspect, building element 100C can serve as the top building element in a retaining wall. In a further aspect, the height dimension of the face panel 102 is less than the height dimension of the beam member 104.

An additional aspect adding to the versatility of building elements 100A-E is that they can be produced from a single mold. During the casting of a building element, a manufacturer can transition between respective building elements by adjusting the internal molding structure (e.g., by filling in receptacles or emptying receptacles to modify the shape to be created by the mold). The adjustments to the internal molding structure allow alternate components of a building element to be formed with a differing shape or orientation.

Although generally described herein as having a substantially vertical orientation, it is contemplated that the retaining walls produced as disclosed herein can have any desired orientation relative to the a horizontal plane, including for example and without limitation, a wall batter producing an angular orientation ranging from about 70 degrees to about 90 degrees relative to the horizontal plane.

Securing Devices

Figure 17:
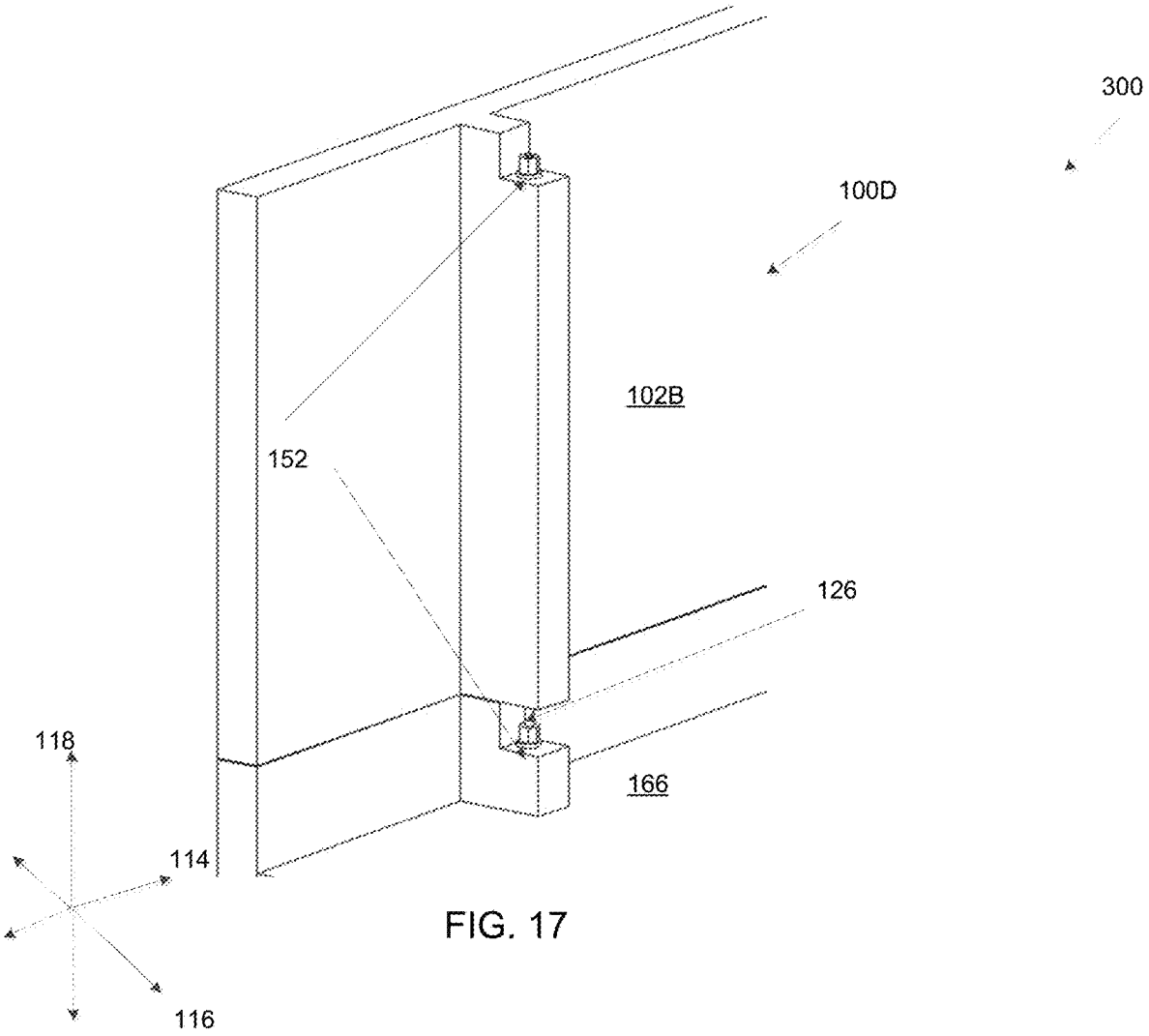
FIG. 17 is a rear perspective view of a retaining wall constructed of exemplary building elements as disclosed herein. As shown, each building element can include a securing device as disclosed herein.

FIG. 17 depicts another exemplary building element 100E comprising a face panel 102, a beam member 104, and a back section 108. In a further aspect, the building element 100D can comprise a securing device 152 for coupling two building elements 100D. The securing device 152 can comprise fixtures that can lock two respective building elements 100D to each other. For example, the securing device 152 can comprise securing rod 126 and securing bracket 154. In a further aspect, the securing rod 126 can be affixed to the bracket 154 by a nut/washer 156 combination. The securing rod 126 and the securing bracket 154 can be oriented such that the securing rod 126 can pass through a void in the alignment bracket 154.

Figure 18:
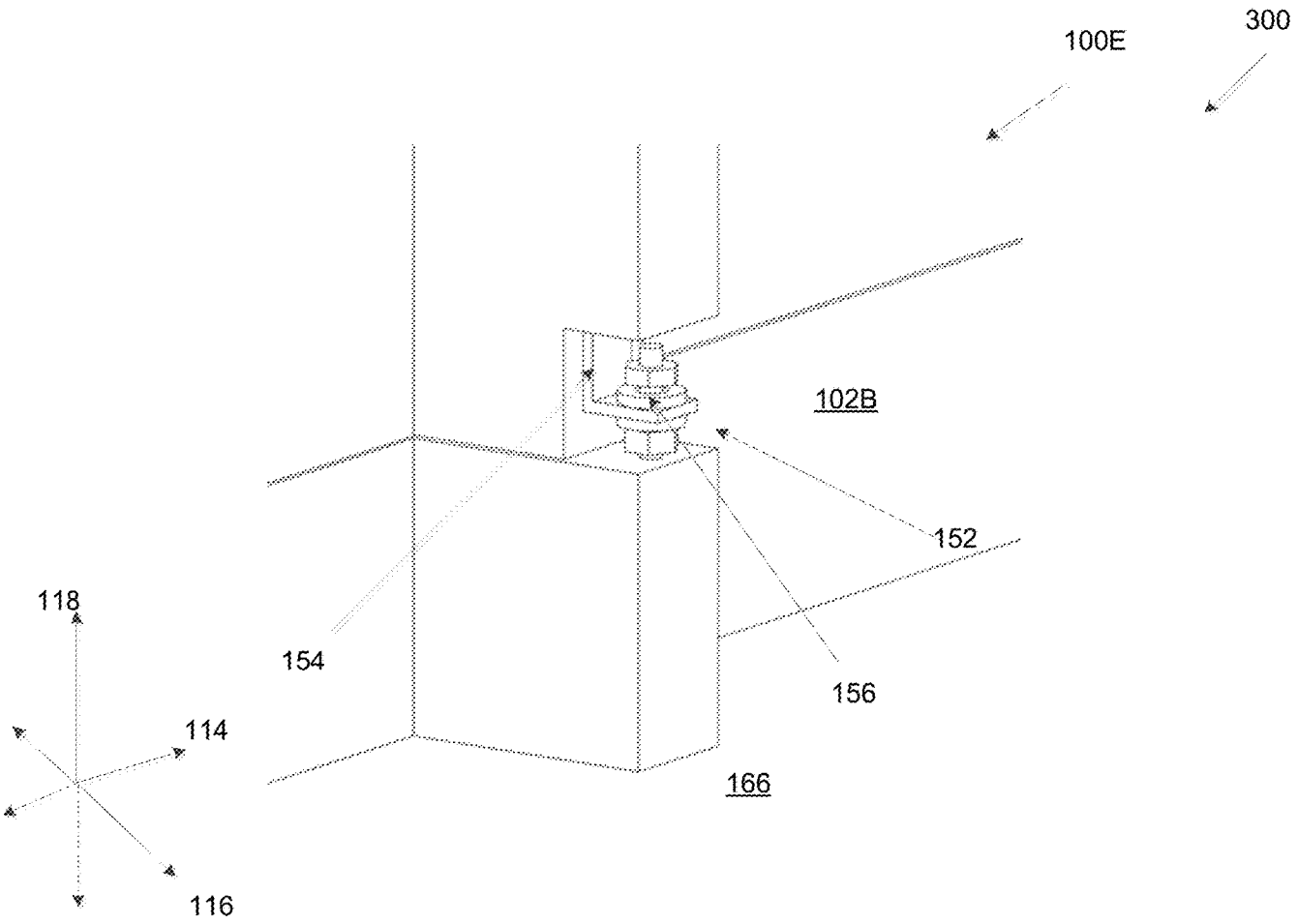
FIG. 18 is a close-up rear perspective view of the lower securing device depicted in FIG. 17.
Figure 19:
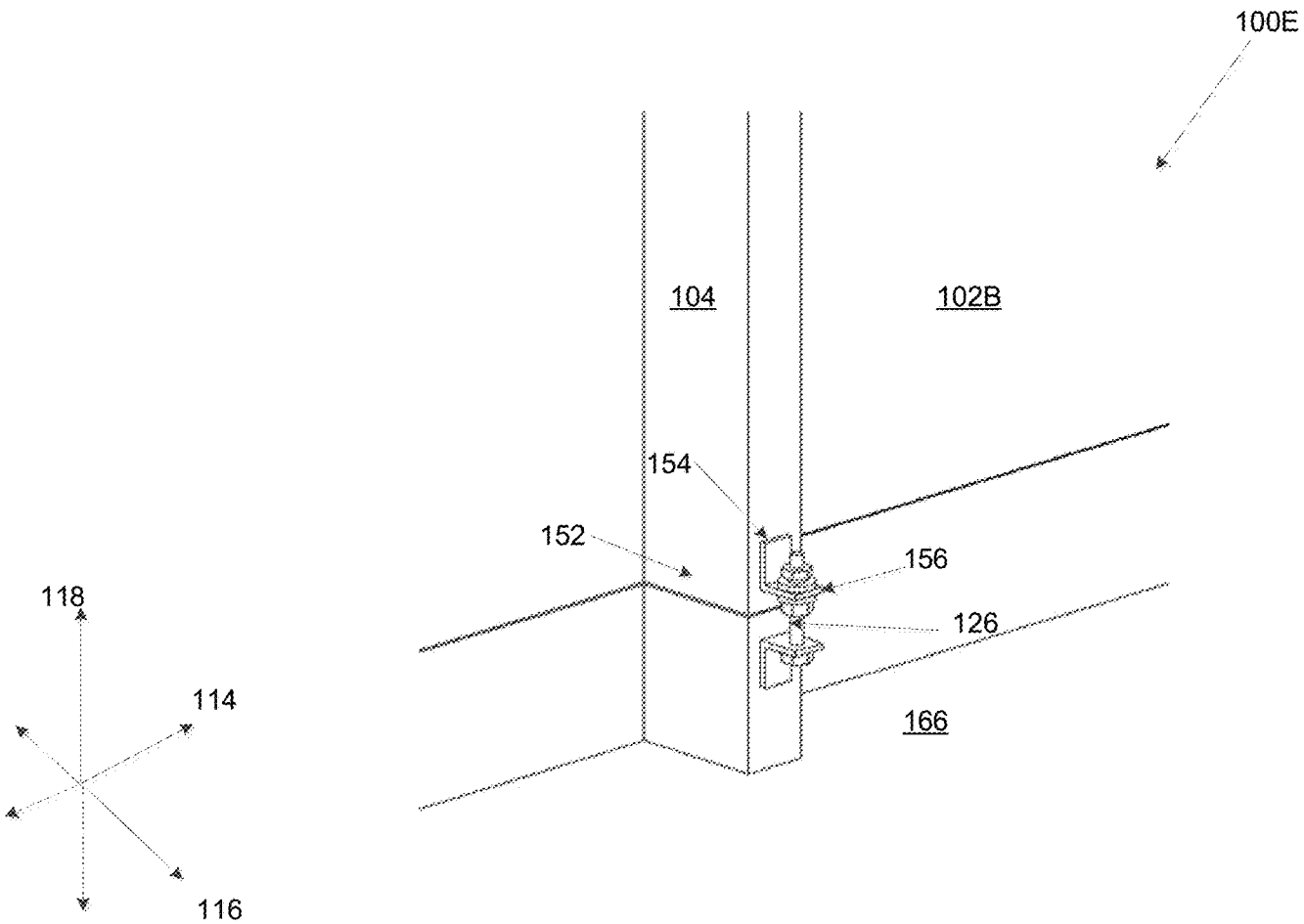
FIG. 19 is a rear perspective view of a retaining wall having an exemplary securing device located at the juncture of two exemplary building elements as disclosed herein.
Figure 20:
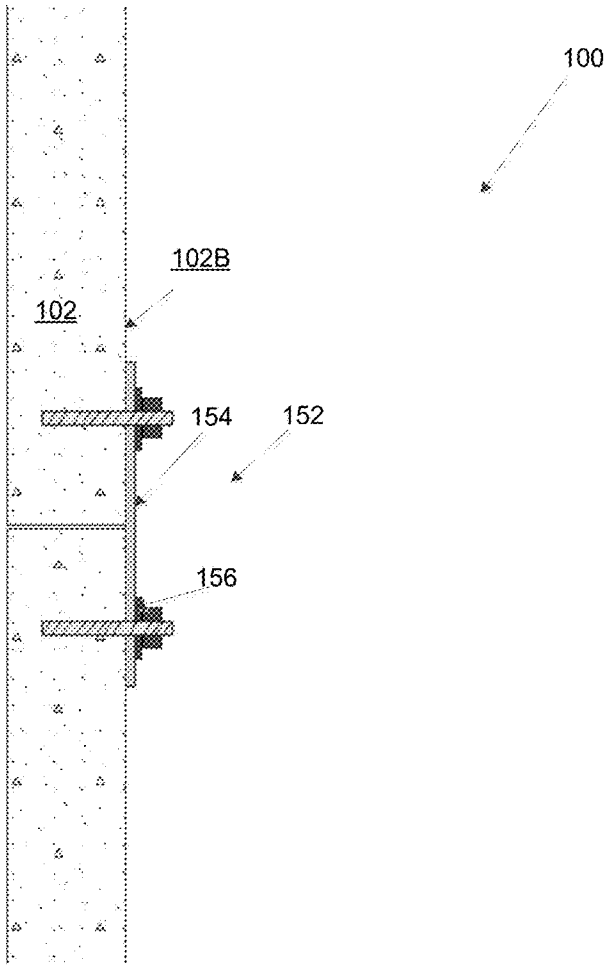
FIG. 20 is a side cross sectional view of an exemplary securing device located at the juncture of two exemplary building elements as disclosed herein.

FIG. 17 depicts another exemplary building element 100E comprising a face panel 102 and a beam member 104. In a further aspect, the building element 100D can comprise a securing device 152 for coupling two building elements 100D. The securing device 152 can comprise fixtures that can lock two respective building elements 100D to each other. The securing device 152 can prevent an upper building element from leaning over during the erection of the retaining wall. For example, the securing device 152 can comprise securing rod 126 and securing bracket 154. In a further aspect, the securing rod 126 can be affixed to the bracket 154 by a nut/washer 156 combination. The securing rod 126 and the securing bracket 154 can be oriented such that the securing rod 126 can pass through a void in the alignment bracket 154. FIGS. 18 and 19 depict alternative configurations of the securing device 152 and their respective attachment to a building element 100E. FIG. 20 depicts another embodiment of the securing device, wherein the securing bracket 154 is not oriented at an angle and only lies in a single plane. In a further aspect, the securing bracket 154 can be attached to the rear surface 102B.

Spacers

Figure 21:
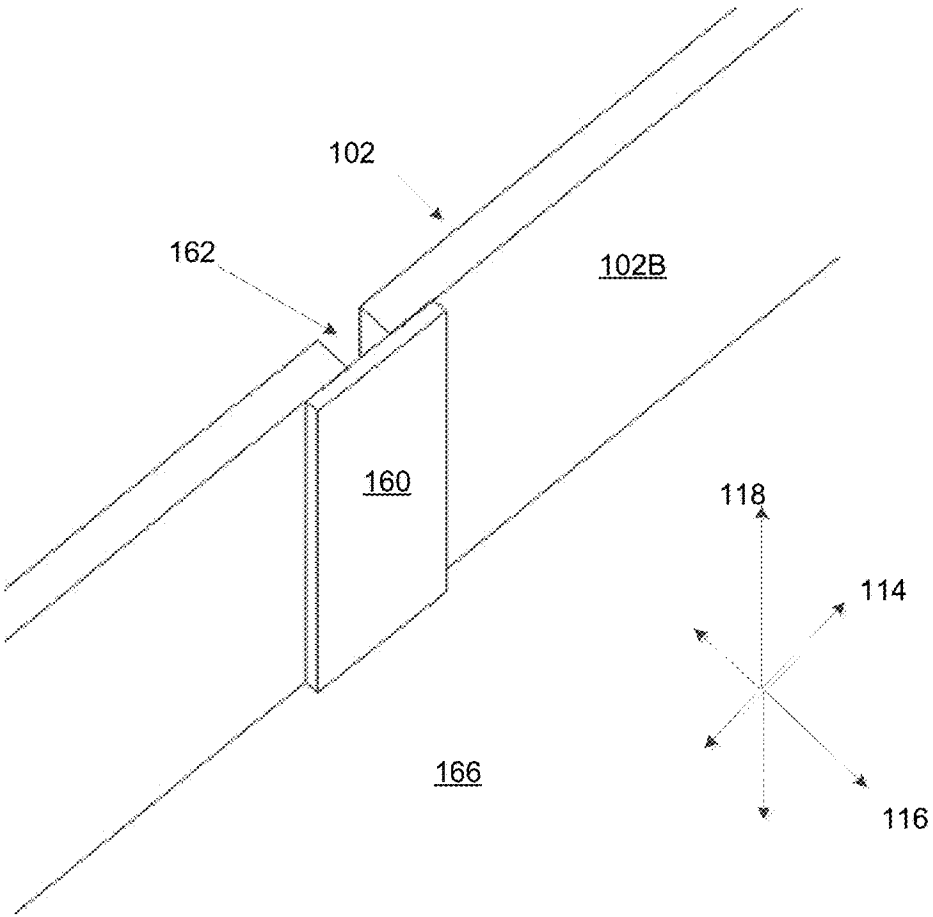
FIG. 21 is a rear perspective view of an exemplary panel spacer located at the juncture of two exemplary building elements as disclosed herein.

In an alternative aspect, as depicted in FIG. 21, two building elements can be oriented in a wall without being physically coupled (i.e., the spacers are not mechanically fixed in any way to the building elements). For example, a spacer 160 can be used to maintain a space 162 between two respective face panels 102. For example, the space 162 allows building elements 100 to settle independently in a vertical or substantially vertical orientation without touching each other. The size of the space may be evaluated based on any determined irregularities in the settlement of backfill. During erection, the spacer 160 can be covered with a geotextile fabric to prevent erosion. In as aspect, the spacer 160 can comprise weather resisting materials such as roof shingles, slate rocks, galvanized stretch metal pieces covered with geotextile fabric. The spacer can also be placed on the rear surface 1026 that faces the earth (filler material) 166. In a further aspect, the space 162 can range from about 0.25 in. to about 4 in., from about 1.5 in. to about 3.0 in, or from about 2.0 in. to about 2.5 in. Optionally, the space 162 can be about 2.5 in. In exemplary aspects, the spacer can have a dimension relative to the first axis 114 that is at least 2 to 3 times the size of space 162. In operation, the spacer 160 can provide a cantilevering function to the front panels toward the open joint, with the spacer cooperating with the common fill behind the panels to provide tolerance and stability in case of an earthquake or irregular settlement.

It is contemplated that the spacer 160 can work with any combination of building elements disclosed herein.

Joint Stiffeners

Figure 22:
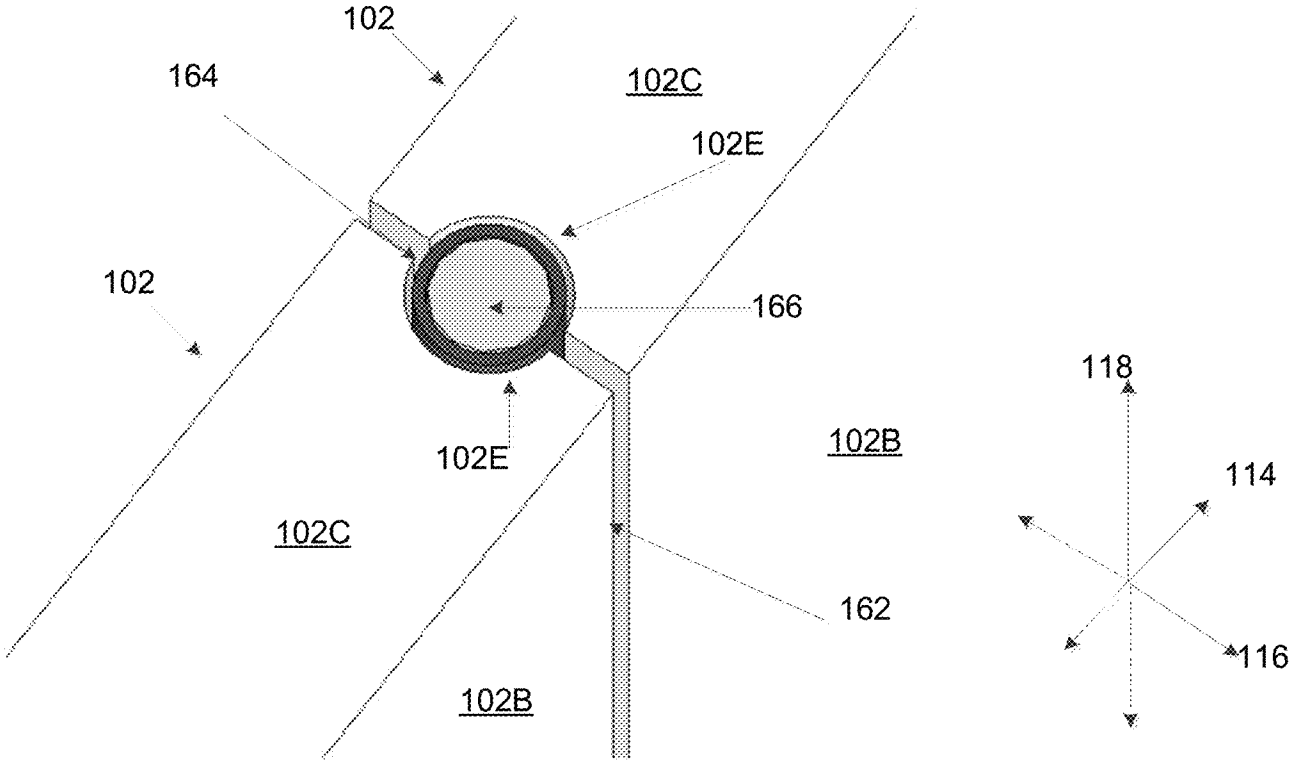
FIG. 22 is a close-up rear perspective view of an exemplary panel reinforcement located at the juncture of two exemplary building elements as disclosed herein.

In an aspect of the retaining wall, a joint 163 between face panels 102 can be strengthened using a joint stiffener 164 as depicted in FIG. 22. In a further aspect, the joint stiffener 164 can be oriented along the height dimension of the face panel 102 along the third axis 118. To facilitate the insert of the circular joint stiffener 164, the surfaces along the third axis 118 of the face panel 102 can define a semicircular channel 102E. It also further contemplates that the joint stiffener can have another geometric cross sectional shape. Similarly, the surface of the face panel can define a channel that mates with the alternative geometric cross sectional shape. In another aspect the joint stiffener 164 can be annular configuration wherein the joint stiffener is filled with a filler material 166. The filler material can comprise earthen material such as dirt, sand, or gravel. In a further aspect, the joint stiffener can comprise polyethylene which is flexible and UV resistant.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A building element configured for coupling to at least one other building element to form a retaining wall, the building element comprising: a face panel comprising a front surface and a rear surface positioned on an opposing side of the face panel from front surface, wherein the face panel comprises a length dimension oriented along a first axis, a width dimension oriented along a second axis that is perpendicular to the first axis, and a height dimension oriented along a third axis that is perpendicular to the first and second axes; and at least one beam member coupled to the rear surface of the face panel, each beam member comprising an upper surface and an opposed lower surface, wherein at least one surface of the upper surface and the lower surface defines an alignment void configured to receive a portion of an adjacent building element during formation of the retaining wall, wherein the beam member is substantially perpendicular to the rear surface of the face panel such that the beam member comprises a length dimension oriented along a second axis and a height dimension oriented along the third axis.

Aspect 2: The building element of aspect 1, wherein the at least one beam member comprises a plurality of beam members.

Aspect 3: The building element of aspect 1 or aspect 2, wherein each beam member comprises a brace section secured to the face panel, wherein the brace section defines at least a portion of the upper surface and the lower surface of the beam member, and wherein at least a portion of the brace section intersects a plane defined by the second axis and the third axis.

Aspect 4: The building element of aspect 3, wherein each beam member of the at least one beam member further comprises a back section coupled to the brace section, wherein the back section comprises a length dimension that extends along the first axis, and wherein the back section cooperates with the brace section to define the beam member.

Aspect 5: The building element of aspect 4, further comprising at least one reinforcement wing, wherein each reinforcement wing is secured to and extends between a side surface of the brace section and either (a) the rear surface of the face panel or (b) a surface of the back section.

Aspect 6: The building element of aspect 4 or aspect 5, wherein the brace section comprises detachable first and second portions, wherein the first portion comprises a first end secured to the rear surface of the face panel and an opposed second end, and wherein the second end of the first portion is configured for complementary engagement with the second portion to cooperatively define the beam member.

Aspect 7: The building element of any one of the preceding aspects, wherein the face panel comprises a top surface, an opposed bottom surface, and at least one projection that extends away from one of the top surface or the bottom surface of the face panel.

Aspect 8: The building element of any one of aspects 3-7, wherein the at least one beam member comprises a plurality of beam members, and wherein the brace section of at least one beam member of the building element defines an aperture extending through the brace section relative to the first axis.

Aspect 9: The building element of any one of aspects 4-8, wherein the building element further comprises an extension element comprising: a mating panel comprising a front mating surface and a rear mating surface oriented on an opposing side of the front mating surface, wherein the mating panel comprises a length dimension oriented along the first axis and a height dimension oriented along the third axis, and at least one extension beam member coupled to the rear mating surface of the mating panel, each extension beam member comprising: an extension brace section comprising a length dimension oriented along the second axis and a height dimension oriented along the third axis, and an extension back section coupled to the extension brace section, wherein the back section comprises a length dimension that extends along the first axis, wherein the front mating surface and a portion of the extension member are configured to engage at least a portion of the back section of the building element.

Aspect 10: The building element of aspect 9, wherein following engagement between the extension member and the back section of the building element, at least one beam member of the building element is positioned in substantial alignment with a corresponding extension beam member relative to the second axis.

Aspect 11: The building element of aspect 9 or aspect 10, wherein the at least one extension beam member comprises a plurality of beam members, and wherein the extension brace section of at least one extension beam member of the building element defines an aperture extending through the extension brace section relative to the first axis.

Aspect 12: An alignment post configured to engage a building element, the alignment post comprising: a stem comprising first and second portions that cooperatively define an axial length dimension of the stem; and a cap comprising a top surface and a bottom surface, wherein the top surface comprises a first cross sectional area and the bottom surface comprises a second cross sectional area, wherein the first portion of the stem is embedded within the cap, and wherein the second portion of the stem extends downwardly from the bottom surface of the cap.

Aspect 13. The alignment post of aspect 12, wherein the stem has a longitudinal axis that is oriented substantially perpendicularly to the bottom surface of the cap.

Aspect 14: The alignment post of aspect 12 or aspect 13, wherein the second cross sectional area is larger than the first cross sectional area, and wherein the cap has an outer diameter that decreases moving from the first cross sectional area to the second cross sectional area.

Aspect 15: The alignment post of any one of aspects 12-14, wherein the alignment post further comprises a reinforcement insert positioned within the cap and at least partially surrounding the first portion of the stem, wherein the reinforcement insert is configured to reinforce the axial position of the stem and to strengthen the cap.

Aspect 16. A retention wall system comprising: a plurality of building elements, wherein each building element comprises: a face panel comprising a front surface and a rear surface positioned on an opposing side of the face panel from front surface, wherein the face panel comprises a length dimension oriented along a first axis, a width dimension oriented along a second axis that is perpendicular to the first axis, and a height dimension oriented along a third axis that is perpendicular to the first and second axes; and at least one beam member coupled to the rear surface of the face panel, each beam member comprising an upper surface and an opposed lower surface, wherein the beam member is substantially perpendicular to the rear surface of the face panel such that the beam member comprises a length dimension oriented along a second axis and a height dimension oriented along the third axis; and an alignment post comprising: a stem comprising first and second portions that cooperatively define an axial length dimension of the stem; and a cap comprising a top surface and a bottom surface, wherein the top surface comprises a first cross sectional area and the bottom surface comprises a second cross sectional area, wherein the first portion of the stem is embedded within the cap, and wherein the second portion of the stem extends downwardly from the bottom surface of the cap, wherein the upper surface of the beam member a first building element of the plurality of building elements defines an alignment void that receives the second portion of the stem of the alignment post, and wherein the lower surface of the beam member of a second building element of the plurality of building elements defines an alignment void that receives the cap of the alignment post, and wherein the first and second building elements cooperate to define at least a portion of a retaining wall.

Aspect 17: The retaining wall of aspect 16, wherein the face panels of the first and second building elements are substantially vertically aligned.

Aspect 18: The retaining wall of aspect 16 or aspect 17, wherein the retaining wall further comprises at least one securing device that mechanically couples adjacent outer surfaces of the first and second building elements.

Aspect 19: The retaining wall of any one of aspects 16-18, wherein the retaining wall further comprises a spacer panel oriented substantially parallel to the front or back surfaces of laterally adjacent face panels, wherein the laterally adjacent face panels are spaced apart relative to the first axis to define a gap between the laterally adjacent face panels, and wherein the spacer panel is positioned to span across the gap and cooperate with the front or back surfaces of the laterally adjacent face panels to enclose a portion of the gap and prevent movement of outside materials into the gap.

Aspect 20: The retaining wall of any one of aspects 16-19, further comprising a reinforcement device placed between laterally adjacent face panels of the plurality of building elements, wherein the reinforcement device comprises an annular member that defines a central bore oriented substantially parallel to the third axis, wherein at least a portion of the central bore of the annular member is filled with a filler material.

Several embodiments of the invention have been disclosed in the foregoing specification. It is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A building element configured for coupling to at least one other building element to form a retaining wall, the building element comprising:

a face panel comprising a front surface and a rear surface positioned on an opposing side of the face panel from front surface, wherein the face panel comprises a length dimension oriented along a first axis, a width dimension oriented along a second axis that is perpendicular to the first axis, and a height dimension oriented along a third axis that is perpendicular to the first and second axes, wherein the face panel comprises a top surface, an opposed bottom surface, and at least one projection that extends upwardly from the top surface of the face panel;

at least one beam member coupled to the rear surface of the face panel, each beam member comprising an upper surface and an opposed lower surface, wherein at least one surface of the upper surface and the lower surface defines an alignment void configured to receive a portion of an adjacent building element during formation of the retaining wall, wherein the beam member is substantially perpendicular to the rear surface of the face panel such that the beam member comprises a length dimension oriented along a second axis and a height dimension oriented along the third axis; and at least one alignment post, each alignment post of the at least one alignment post defining a respective projection of the at least one projection that extends upwardly from the top surface of the face panel, each alignment post comprising:

a stem comprising first and second portions that cooperatively define an axial length dimension of the stem; and a cap comprising a top surface and a bottom surface, wherein the top surface comprises a first cross sectional area and the bottom surface comprises a second cross sectional area, wherein the first portion of the stem is embedded within the cap, and wherein the second portion of the stem extends downwardly from the bottom surface of the cap, and wherein the alignment post further comprises a reinforcement insert positioned within the cap and at least partially surrounding the first portion of the stem, wherein the reinforcement insert is configured to reinforce the axial position of the stem and to strengthen the cap.

2. The building element of claim 1, wherein the at least one beam member comprises a plurality of beam members.

3. The building element of claim 1, wherein each beam member comprises a brace section secured to the face panel, wherein the brace section defines at least a portion of the upper surface and the lower surface of the beam member, and wherein at least a portion of the brace section intersects a plane defined by the second axis and the third axis.

4. The building element of claim 3, wherein each beam member of the at least one beam member further comprises a back section coupled to the brace section, wherein the back section comprises a length dimension that extends along the first axis, and wherein the back section cooperates with the brace section to define the beam member.

5. The building element of claim 4, further comprising at least one reinforcement wing, wherein each reinforcement wing is secured to and extends between a side surface of the brace section and either (a) the rear surface of the face panel or (b) a surface of the back section.

6. The building element of claim 4, wherein the brace section comprises detachable first and second portions, wherein the first portion comprises a first end secured to the rear surface of the face panel and an opposed second end, and wherein the second end of the first portion is configured for complementary engagement with the second portion to cooperatively define the beam member.

7. The building element of claim 4, wherein the building element further comprises an extension element comprising:

a mating panel comprising a front mating surface and a rear mating surface oriented on an opposing side of the front mating surface, wherein the mating panel comprises a length dimension oriented along the first axis and a height dimension oriented along the third axis, and at least one extension beam member coupled to the rear mating surface of the mating panel, each extension beam member comprising:

an extension brace section comprising a length dimension oriented along the second axis and a height dimension oriented along the third axis, and an extension back section coupled to the extension brace section, wherein the back section comprises a length dimension that extends along the first axis, wherein the front mating surface and a portion of the extension member are configured to engage at least a portion of the back section of the building element.

8. The building element of claim 7, wherein following engagement between the extension member and the back section of the building element, at least one beam member of the building element is positioned in substantial alignment with a corresponding extension beam member relative to the second axis.

9. The building element of claim 8, wherein the at least one extension beam member comprises a plurality of beam members, and wherein the extension brace section of at least one extension beam member of the building element defines an aperture extending through the extension brace section relative to the first axis.

10. The building element of claim 3, wherein the at least one beam member comprises a plurality of beam members, and wherein the brace section of at least one beam member of the building element defines an aperture extending through the brace section relative to the first axis.

11. The building element of claim 1, wherein the face panel further comprises at least one projection that extends downwardly from the bottom surface of the face panel.

12. An alignment post configured to engage a building element, the alignment post comprising:

a stem comprising first and second portions that cooperatively define an axial length dimension of the stem; and a cap comprising a top surface and a bottom surface, wherein the top surface comprises a first cross sectional area and the bottom surface comprises a second cross sectional area, wherein the first portion of the stem is embedded within the cap, and wherein the second portion of the stem extends downwardly from the bottom surface of the cap, and wherein the alignment post further comprises a reinforcement insert positioned within the cap and at least partially surrounding the first portion of the stem, wherein the reinforcement insert is configured to reinforce the axial position of the stem and to strengthen the cap.

13. The alignment post of claim 12, wherein the stem has a longitudinal axis that is oriented substantially perpendicularly to the bottom surface of the cap.

14. The alignment post of claim 12, wherein the second cross sectional area is larger than the first cross sectional area, and wherein the cap has an outer diameter that decreases moving from the first cross sectional area to the second cross sectional area.

15. A retention wall system comprising:

a plurality of building elements, wherein each building element comprises:

a face panel comprising a front surface and a rear surface positioned on an opposing side of the face panel from front surface, wherein the face panel comprises a length dimension oriented along a first axis, a width dimension oriented along a second axis that is perpendicular to the first axis, and a height dimension oriented along a third axis that is perpendicular to the first and second axes; and at least one beam member coupled to the rear surface of the face panel, each beam member comprising an upper surface and an opposed lower surface, wherein the beam member is substantially perpendicular to the rear surface of the face panel such that the beam member comprises a length dimension oriented along a second axis and a height dimension oriented along the third axis; and an alignment post comprising:

a stem comprising first and second portions that cooperatively define an axial length dimension of the stem; and a cap comprising a top surface and a bottom surface, wherein the top surface comprises a first cross sectional area and the bottom surface comprises a second cross sectional area, wherein the first portion of the stem is embedded within the cap, and wherein the second portion of the stem extends downwardly from the bottom surface of the cap, wherein the upper surface of the beam member of a first building element of the plurality of building elements defines an alignment void that receives the second portion of the stem of the alignment post, and wherein the lower surface of the beam member of a second building element of the plurality of building elements defines an alignment void that receives the cap of the alignment post, and wherein the first and second building elements cooperate to define at least a portion of a retaining wall, wherein the retaining wall further comprises a spacer panel oriented substantially parallel to the front or back surfaces of laterally adjacent face panels, wherein the laterally adjacent face panels are spaced apart relative to the first axis to define a gap between the laterally adjacent face panels, and wherein the spacer panel is positioned to span across the gap and cooperate with the front or back surfaces of the laterally adjacent face panels to enclose a portion of the gap and prevent movement of outside materials into the gap.

16. The retaining wall of claim 15, wherein the face panels of the first and second building elements are substantially vertically aligned.

17. The retaining wall of claim 15, wherein the retaining wall further comprises at least one securing device that mechanically couples adjacent outer surfaces of the first and second building elements.

18. The retaining wall of claim 15, further comprising a reinforcement device placed between laterally adjacent face panels of the plurality of building elements, wherein the reinforcement device comprises an annular member that defines a central bore oriented substantially parallel to the third axis, wherein at least a portion of the central bore of the annular member is filled with a filler material.

* * * * *